US005220389A

United States Patent [19]

Kishimoto et al.

[11] Patent Number: 5,220,389

[45] Date of Patent: Jun. 15, 1993

[54] IMAGE FORMING APPARATUS HAVING A CONTROLLED FIXING MEANS

[75] Inventors: Hiroyuki Kishimoto, Toyokawa; Shoji Imaizumi, Shinshiro; Tsuneo Kitagawa, Toyohashi, all of Japan

[73] Assignee: Minolta Camera Kabushiki Kaisha, Osaka, Japan

[21] Appl. No.: 814,180

[22] Filed: Dec. 30, 1991

[30] Foreign Application Priority Data

Jan. 10, 1991 [JP] Japan ..... 3-1311

[51] Int. Cl.[5] ..... G03G 15/20; G03G 15/00

[52] U.S. Cl. ..... 355/285; 219/216; 219/492

[58] Field of Search ..... 355/208, 285, 311; 219/216, 492, 494, 505; 340/588, 589

[56] References Cited

U.S. PATENT DOCUMENTS 3,926,519 12/1975 Rebres ..... 355/208
4,374,321 2/1983 Cunningham, Jr. et al. ..... 219/497
4,415,800 11/1983 Dodge et al. ..... 219/497
4,496,829 1/1985 Black et al. ..... 219/497

FOREIGN PATENT DOCUMENTS 58-201116 11/1983 Japan ..... 219/492
1-221780 9/1989 Japan ..... 355/208
2-62575 3/1990 Japan .

*Primary Examiner*—Joan H. Pendegrass
*Attorney, Agent, or Firm*—Burns, Doane, Swecker & Mathis

[57] ABSTRACT

An image forming apparatus maintaining the fixing temperature at a fixed level, by detecting the surface temperature of a heating roller provided internally with a heater in a fixing unit, and by controlling an on-time which starts upon the surface temperature reaching a predetermined temperature and ends when the heater is switched on and an off-time which starts upon the surface temperature reaching the predetermined temperature and ends when the heater is switched off. The on-time and off-time data are stored in a memory corresponding to use conditions such as ambient temperature and the type of paper to be used. Initially, an image fixing operation is executed in accordance with the data prestored in the memory, and transition of the surface temperature of the heating roller is detected which results from the image fixing operation. Data concerning new on-time and off-time are calculated on the basis of the detection result, and the calculation result is used as feedback for a next image fixing operation.

22 Claims, 36 Drawing Sheets

IMAGE FORMING APPARATUS HAVING A CONTROLLED FIXING MEANS

BACKGROUND OF THE INVENTION

1. Field of the invention

The present invention relates to an image forming apparatus such as an electrophotographic copying machine, laser printer, or the like, and particularly to a fixing unit incorporated into the image forming apparatus for fixing a toner image on a sheet.

2. Description of the Related Art

In a fixing unit provided in an image forming apparatus for fixing a toner image on a sheet, there is included a heating roller in the form of a cylinder which is internally provided with a heater. The heater is on-off controlled while a surface temperature of the heating roller being detected so that the surface temperature of the heating roller (fixing temperature) can be maintained at a substantially fixed level.

However, the heat released from the heater is sequentially propagated from the air within the heating roller to an inner circumferential surface of the roller, and to an outer circumferential surface of the roller. Accordingly, there is some delay in change in the surface temperature of the heating roller relative to the on-off control of the heater. As a consequence, the surface temperature continues to rise (overshoot) even in the case where the heater is turned off at a fixed temperature. On the other hand, the surface temperature continues to fall (undershoot) even in the case where the heater is turned on at a fixed temperature.

The overshoot and undershoot not only vary in individual fixing units in some degree, but also depend on the ambient temperature and the size of the sheet to be used. Normally, a target temperature based on which the heater is on-off controlled is determined assuming a fixed ambient temperature and a standard size of sheet. However, in the case where the ambient temperature rises or a small-sized sheet is used, the overshoot becomes larger, whereby the sheet is displaced relative to the heating roller due to warping thereof and melting of toner. On the other hand, in the case where the ambient temperature falls or a large-sized sheet is used, the undershoot becomes larger, whereby the following problems will occur: toner is fixed to the sheet in an unsatisfactory manner; toner which is not fixed to the sheet deposits on the heating roller and stains a next sheet.

SUMMARY OF THE INVENTION

It is an object of the invention to provide an image forming apparatus capable of maintaining a fixing temperature at a specified level regardless of changes in ambient temperature.

It is another object of the invention to provide an image forming apparatus capable of maintaining a fixing temperature at a specified level regardless of the type of a sheet to be used.

It is still another object of the invention to provide an image forming apparatus which demonstrates a satisfactory fixing performance by maximally suppressing an overshoot and an undershoot.

An image forming apparatus in accordance with the invention measures the surface temperature of a heating roller of a fixing unit having a heater provided therein and maintains the fixing temperature at a specified level by controlling an on-time which starts upon the surface temperature reaching a specified temperature and lasts until the heater is turned on, and an off-time which starts upon the surface temperature reaching the specified temperature and lasts until the heater is turned off. Data concerning the on-time and off-time are stored in a memory beforehand according to use conditions such as the ambient temperature and the size of sheet to be used. The fixing operation is initially carried out in accordance with the data prestored in the memory. Transition of the surface temperature of the heating roller accompanied by the fixing operation is detected, and new data concerning the on-time and off-time are calculated based on the detection result. The calculation result is fed back to the next fixing operation.

The above and further objects and features of the invention will be more fully apparent from the following detailed description with accompanying drawings.

DESCRIPTION OF THE PREFERRED EMBODIMENTS

Hereinafter, embodiments of the present invention will be described with reference to the accompanying drawings.

FIRST EMBODIMENT

Figure 1:
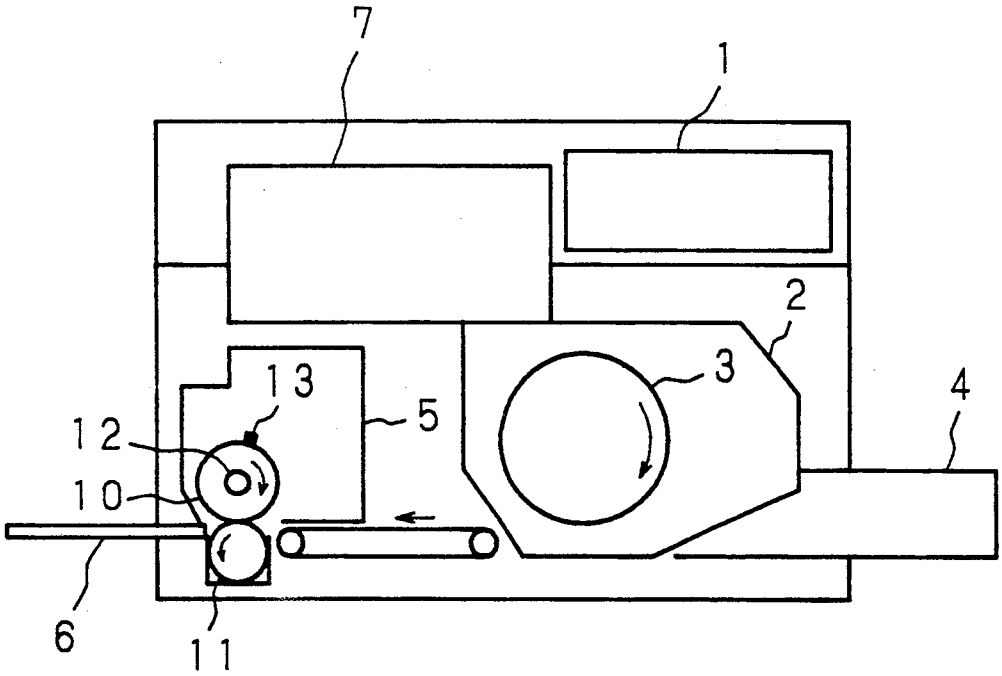
FIG. 1 is a schematic diagram showing a laser beam printer.

A first embodiment will be described with reference to FIGS. 1 to 30. FIG. 1 is a diagram schematically showing a construction of a laser beam printer provided with a fixing unit 5 representing a first embodiment of the invention. This printer comprises a laser beam scanning/optical unit 1, an image forming unit 2 including a photosensitive drum 3, a feeding unit 4 including a cassette removably attachable to a main body of the printer, a toner fixing unit 5, a discharge tray 6 and a central processing unit (CPU) 7. Individual elements and an image forming process are identical to the existing image forming apparatus, and thus description thereof will be omitted.

The fixing unit 5 comprises a heating roller 10 and a pressing roller 11. The heating roller 10 is provided internally with a heat lamp (hereinafter referred to as a heater) 12 as heat source. The pressing roller 11 is disposed below the heating roller 10 for pressing the roller 10 from below. A thermister 13 is disposed in a specified position in the vicinity of an outer circumferential surface of the heating roller 10 for detecting the temperature.

Figure 2:
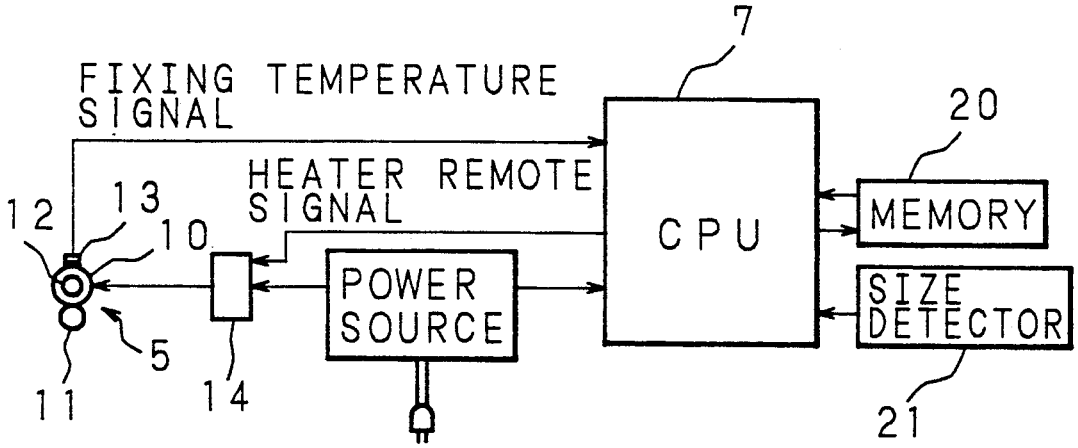
FIG. 2 is a block diagram showing a control circuit for a fixing unit.

As shown in FIG. 2, to the CPU 7 are connected a memory 20 for storing control data to be described below and a size detector 21 for detecting the size of a sheet to be used. A fixing temperature signal from the thermistor 13 is inputted to the CPU 7, which in turn outputs a heater remote signal to a switch 14 through which the heater 12 is on-off controlled in a manner to be described below.

Figure 3:
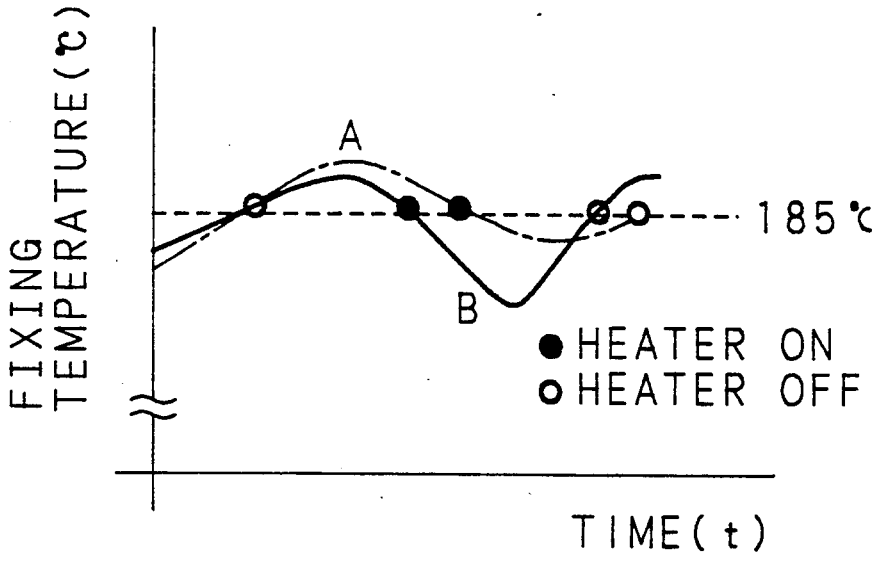
FIG. 3 is a chart showing a difference in fixing temperature change due to a difference in ambient temperature.

With a temperature control by on-off controlling the heater 12, a surface temperature of the heating roller 10 temporarily rises and then falls after the heater 12 is turned off (overshoot), and the surface temperature temporarily falls and then rises after the heater 12 is turned on (undershoot) as shown in FIG. 3 according to a thermal capacity of a heat transmission path from the heater 12 to the heating roller 10. FIG. 3 shows the result of a control for maintaining the surface temperature of the heating roller 10 at 185° C., wherein a one-dot chain line A represents a state where the ambient temperature is high, and a solid line B represents a state where the ambient temperature is low. As will be apparent from FIG. 3, the overshoot becomes large when the ambient temperature is high. On the other hand, the undershoot becomes large when the ambient temperature is low. The undershoot becomes even larger when the sheet is passed through.

In the first embodiment, in order to maintain the surface temperature at a target temperature by maximally suppressing the overshoot and undershoot, the heater 12 is turned on or off before the surface temperature reaches the target temperature. In order to suppress the overshoot, the heater 12 is turned off earlier when the ambient temperature is high than when the ambient temperature is low. In order to suppress the undershoot, the heater 12 is turned on earlier when the ambient temperature is low than when the ambient temperature is high.

As a parameter for determining fixing temperature characteristics, there exist a variation in thermal capacity inherent in the fixing unit 5, a variation in output of the heater 12, and differences in size of sheets besides the ambient temperature. The fixing temperature characteristics determined by these parameters will be known when a printing operation is repeated several times. Accordingly, in case of a multi-printing operation in which more than several prints are to be made, the temperature can be controlled by means of a feedback control in consideration of variation factors. However, since a feedback control cannot be effected for the first several prints, one temperature control pattern is selected from a plurality of those prestored in the memory 20. The printing operation for first several prints is executed according to the selected temperature control pattern. In the case where the printing operation is executed more than several times, the temperature control pattern is corrected based on data obtained from the preceding printing operation, and the printing operation for the subsequent prints is executed according to the corrected temperature control pattern. In this way, the control data is renewed each temperature control pattern, thereby sufficiently responding to factors which are not to change for a short period of time, such as changes over time which are inherent in the fixing unit 5 and output of the heater 12.

However, the prior fixing control data is useless for factors which are to change greatly each printing operation, such as the sheet size and the ambient temperature (e.g., early morning and daytime). Accordingly, it is necessary to store a plurality of control data classified according to these factors.

Figure 4:
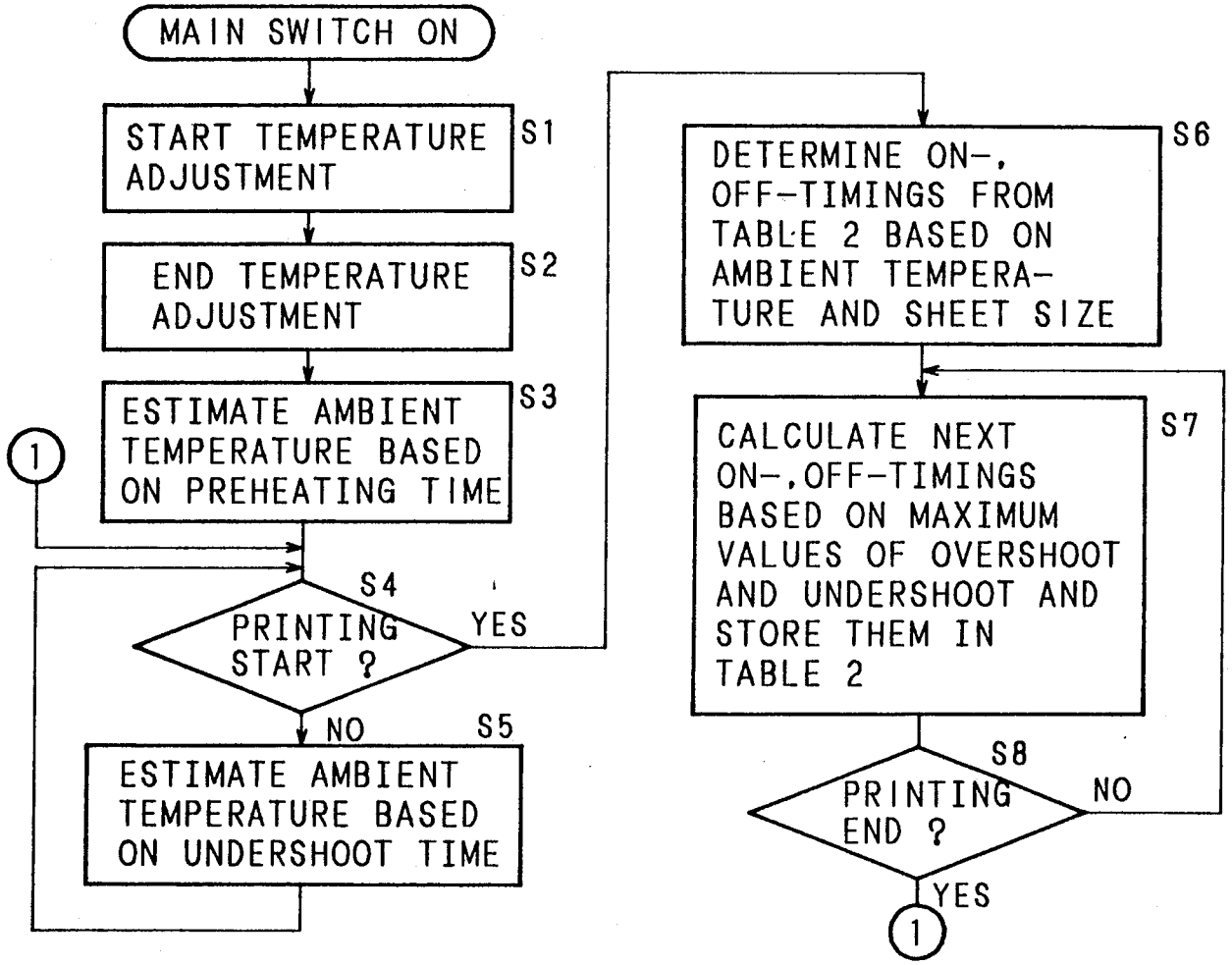
FIG. 4 is a flow chart showing summarily a temperature control.

FIG. 4 is a flow chart conceptually showing the foregoing control. More specifically, when a main switch of the printer is turned on, the temperature of the fixing unit 5 is adjusted in Step S1, i.e., preheating of the heating roller 10 is started so as to rise the surface temperature of the heating roller 10 up to a predetermined level. Upon completing adjustment of the temperature of the heating roller 10 in Step S2, the external ambient temperature is estimated in Step S3 based on the time required for the preheating of the roller 10. In the case where a printing operation has not started yet (NO in Step S4), i.e., the printer is in a standby state, the external ambient temperature is estimated based on an undershoot time while the surface temperature of the heating roller 10 is changing in Step S5. Estimation of the ambient temperature is carried out by the use of TABLE 1 prestored in the memory 20.

TABLE 1

(AMBIENT TEMPERATURE ESTIMATION)

| PREHEATING (sec.) | UNDERSHOOT TIME (sec.) | ESTIMATED AMBIENT TEMPERATURE |
|---|---|---|
| 60 OR LESS | 2 OR SHORTER | HIGH TEMP. |
| 60 OR LESS | 5 TO 2 | NORMAL TEMP. |
| 70 TO 80 | 10 TO 5 | LOW TEMP. 1 |
| 80 OR MORE | 10 OR LONGER | LOW TEMP. 2 |

When the printing operation is started (YES in Step S4), timings at which the heater 12 is turned on or off are determined from TABLE 2 based on the external ambient temperature and a sheet size to be used in Step S6.

TABLE 2

(HEATER ON-, OFF-TIMING)

| AMBIENT TEMP. | LARGE | MEDIUM | SMALL |
|---|---|---|---|
| HIGH TEMP. | t on1 | t on2 | t on3 |
| | t of1 | t of2 | t of3 |
| NORMAL TEMP. | t on4 | t on5 | t on6 |
| | t of4 | t of5 | t of6 |
| LOW TEMP. 1 | t on7 | t on8 | t on9 |
| | t of7 | t of8 | t of9 |
| LOW TEMP. 2 | t on10 | t on11 | t on12 |
| | t of10 | t of11 | t of12 |

The next heater on-, off-timings are calculated based on the maximum values of the overshoot and undershoot according to the actual temperature control characteristics during the printing operation in Step S7, and TABLE 2 is rewritten and stored in the memory 20. Calculation in Step S7 is executed in accordance with TABLE 3. While the printing operation is being continued (NO in Step S8), the printing operation is executed with the sequentially corrected control patterns. When the printing operation is completed (YES in Step S8), the main routine returns to Step S4.

TABLE 3

(CORRECTION OF ON-, OFF-TIMINGS)

| OFF-TIMING | UNDERSHOOT | ON-TIMING | OVERSHOOT |
|---|---|---|---|
| Δtf | Δcof | Δtn | Δcon |
| Δtf1 | Δcof1 | Δtn1 | Δcon1 |
| Δtf' | — | Δtn' | — |

Parameters (variation factors) of the fixing temperature will be described here.

AMBIENT TEMPERATURE:

Generally, printers and electrophotographic copying machines are not provided with a device for measuring an external ambient temperature. It is not preferable to provide such a measuring device specially for embodying the present invention since it results in complicated construction of the printers and the copying machines. In view of this, a method has been developed which estimates the external ambient temperature without providing the measuring device. One method is, as shown in Step S3 of FIG. 4, to measure the external ambient temperature on the basis of the time required from the power-on to completion of preheating of the fixing unit 5. Another method is, as shown in Step 5 of FIG. 4, to measure the external ambient temperature on the basis of the undershoot time during the standby state.

Figure 5:
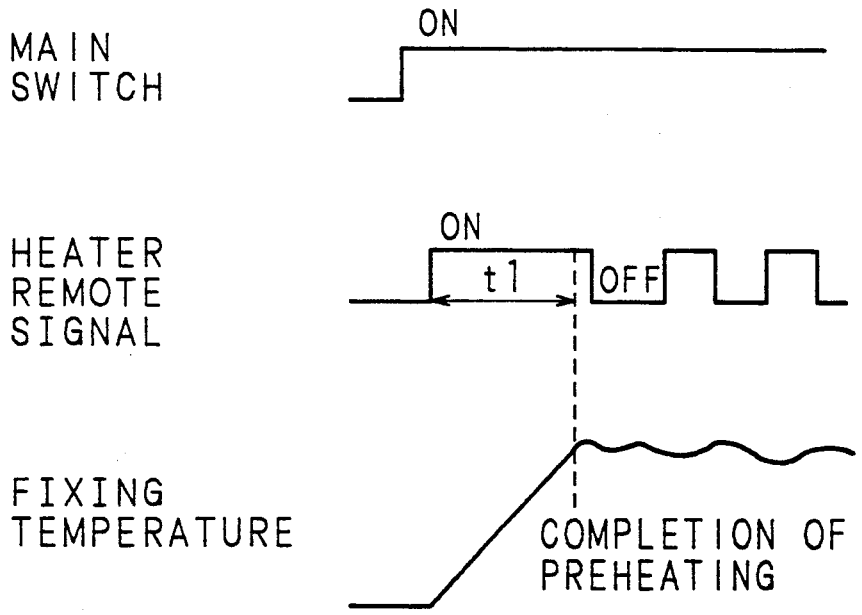
FIG. 5 is a chart showing a control timing and a change in the fixing temperature in an initial preheating control.

FIG. 5 shows a change in the fixing temperature (the surface temperature of the heating roller 10) immediately after the main is turned on and thereby the heater remote signal is changed to on-level. The ambient temperature changes with a time t1 which starts upon the rise of the heater remote signal to the on-level and lasts until completion of the preheating. Therefore, the ambient temperature can be estimated according to the value of the preheating time t1.

Figure 6:
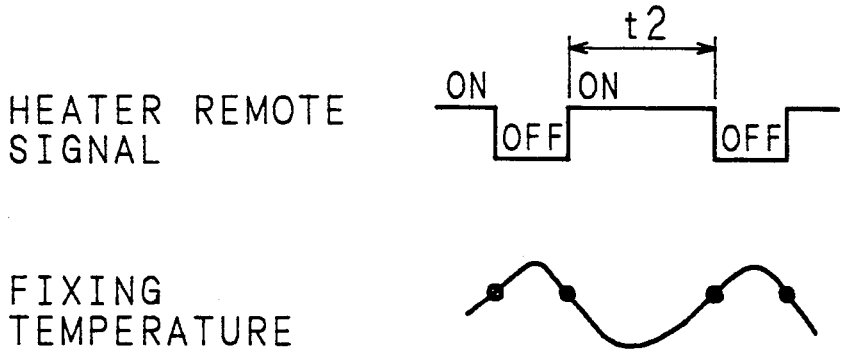
FIG. 6 is a chart showing an on-off control timing and a change in the fixing temperature of the heater in a standby state.

FIG. 6 shows a change in the fixing temperature in a standby state. A time t2 which starts upon the rise of the heater remote signal to the on-level and lasts until the fall thereof to the off-level depends on the ambient temperature. Therefore, the ambient temperature can be estimated according to the value of the on-off time t2.

In the first embodiment, as shown in TABLE 1, the ambient temperature is estimated into four stages: high temperature; normal temperature; low temperature 1; and low temperature 2.

SHEET SIZE:

The degree at which the sheet takes the heat from the heating roller 10 when passing through the fixing unit 5 differs depending on the size thereof. The larger the sheet, especially with respect to a feeding direction thereof, the more heat is taken from the heating roller 10. In the first embodiment, the size of sheets is classified into three groups, namely "large," "medium," and "small" as shown in TABLE 2. "Large" sheets include those whose length in the feeding direction is 300 mm or longer (for example, A3, A4). "Medium" sheets include those whose length in the feeding direction lies between 251 mm and 299 mm (for example, A4 when longitudinally fed, B5). "Small" sheets include those whose length in the feeding direction is 250 mm or shorter (for example, A5, B6).

In view of four stages of ambient temperature and three groups of sheet size, initial temperature control patterns, twelve in total (see TABLE 2), are prepared in advance and stored in the memory 20.

Next, there will be described correction of the temperature control pattern.

Figure 7:
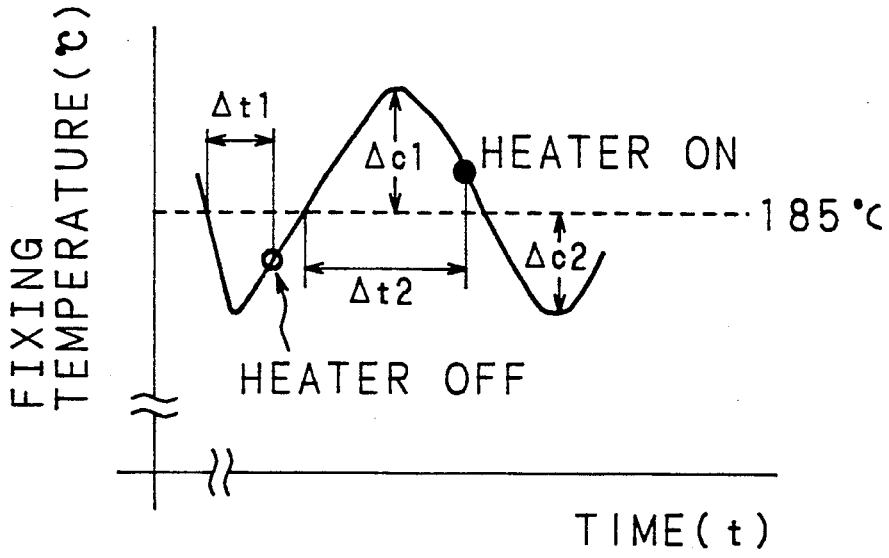
FIG. 7 is a chart showing a change in the fixing temperature before a temperature control pattern is corrected.
Figure 8:
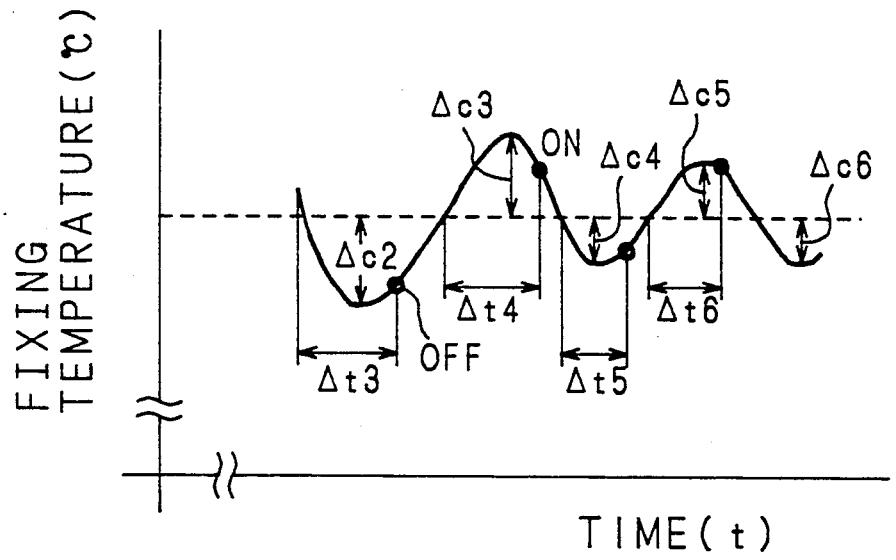
FIG. 8 is a chart showing a change in the fixing temperature after the temperature control pattern is corrected.

As shown in FIG. 7, a moment at which the fixing temperature becomes lower than the target temperature of 185° C. is used as a starting point. It is assumed that the overshoot of Δc1 occurs when the heater 12 is turned off a time Δt1 after the starting point of the overshoot. Further, a moment at which the fixing temperature becomes in excess of the target temperature of 185° C. is used as a starting point of the undershoot. It is assumed that the undershoot of Δc2 occurs when the heater 12 is turned on Δt2 after the starting point.

Regarding the overshoot, the overshoot Δcn (n=1, 3, 5, . . . ) can be represented as a function of Δtn (n=1, 3, 5, . . . ) which starts from the starting point thereof and lasts until the heater 12 is turned off. This function Δcn can be approximated to the following linear function (1) of Δtn:

$$\Delta tn = an\Delta tn + bn \quad (1)$$

The purpose here is to obtain $\Delta tn$ which makes $\Delta cn$ approximately 0. Firstly, $\Delta c(n+2)=a(n+2)\Delta t(n+2)+b(n+2)$ can be obtained from the equation (1). Constants an, bn are respectively equal to $a(n+2)$, $b(n+2)$, i.e., $an=a(n+2)$, $bn=b(n+2)$. From these expressions, the constants an, bn are obtained as follows:

$$an=(\Delta cn-\Delta c(n+2))/(\Delta tn-\Delta t(n+2)) \quad (2)$$

$$bn=\Delta c(n+2)-t(n+2)\times(\Delta cn-\Delta c(n+2))/(\Delta tn-\Delta t(n+2)) \quad (3)$$

By using $\Delta t1$ obtained from TABLE 2, $\Delta cn$ can be measured as shown in FIG. 7. Here, in order to apply the equations (2), (3), two pairs of data are required. Accordingly, $\Delta c3$ is measured tentatively on the assumption that $\Delta t3=\frac{2}{3}(\Delta t1)$. By using two pairs of data ($\Delta t1$, $\Delta c1$), ($\Delta t3$, $\Delta c3$) thus obtained, constants a1, b1 are obtained based on the equations (2), (3).

By using the constants a1, b1, the following equation (4) can be obtained based on the equation (2).

$$\Delta t5=(\Delta c5-b1)/a1=-b1/a1 \quad (4)$$

wherein $\Delta c5=0$.

Figure 9:
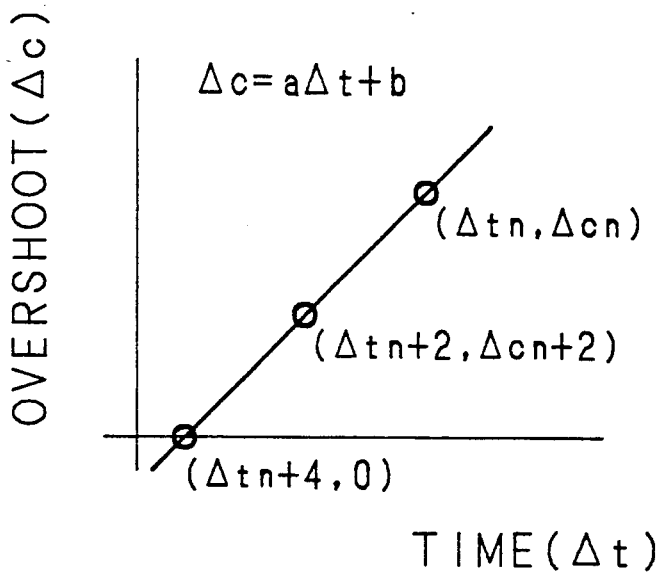
FIG. 9 is a chart representing the overshoot value as a function of a heater off-timing $\Delta t$.

Thereby, the time $\Delta t5$ determining a next timing at which the heater 12 is turned off (see FIG. 8) can be obtained. Similarly, the time $\Delta t7$ determining a further next timing at which the heater 12 is turned off can be obtained by calculating a3, b3 from another two pairs of data ($\Delta t3$, $\Delta c3$), ($\Delta t5$, $\Delta c5$) $\Delta t7=-b3/a3$ Hereafter, these calculations are made repeatedly. FIG. 9 is a graph showing the calculation results.

What should be taken note of here is:

(1) In the case where $\Delta tn$ is calculated to be negative, it is assumed that $\Delta tn=0$ since the negative control cannot be executed.

Figure 10:
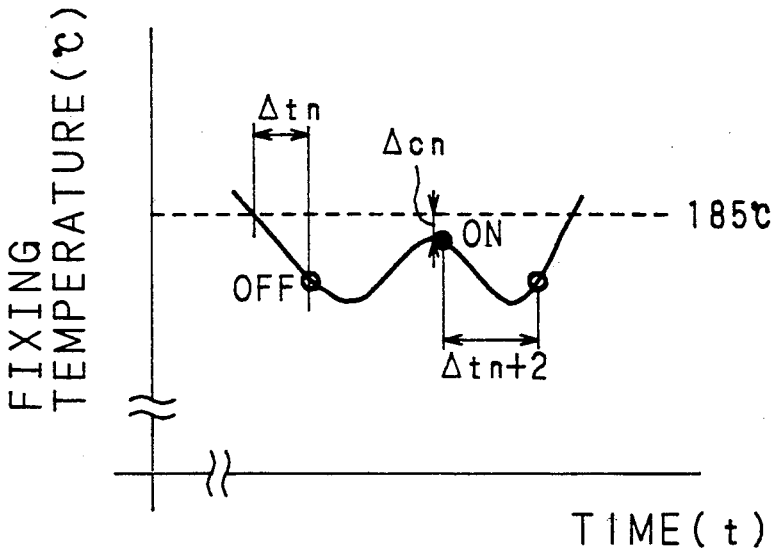
FIG. 10 is a chart showing a control in the case where the peak of the overshoot does not reach a target temperature.

(2) In the case where a peak temperature of the overshoot is below the target temperature of 185° C. as shown in FIG. 10, i.e., $\Delta cn$ is negative, the heater 12 is turned on at that moment, which is in turn used as a starting point of the time $\Delta t(n+2)$ for the next heater off-timing.

Figure 11:
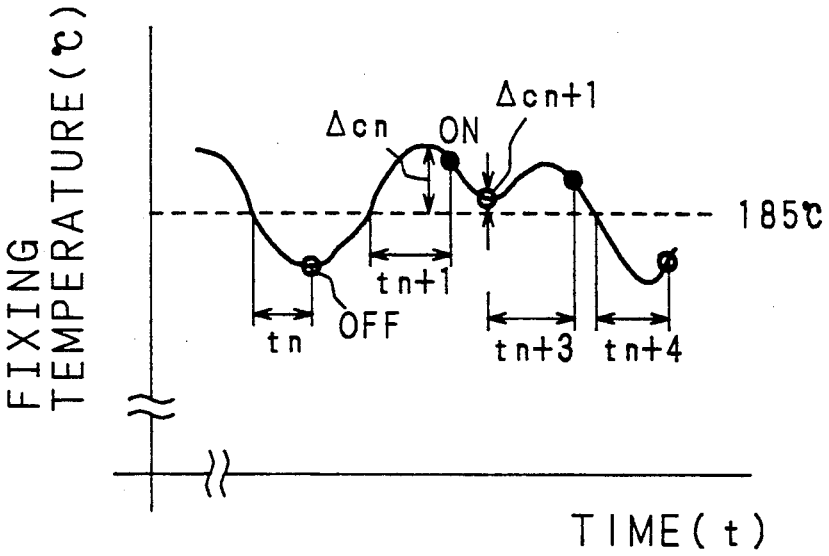
FIG. 11 is a chart showing a control in the case where the bottom of the undershoot does not reach the target temperature.

(3) In the case where the heater on-timing is too early, whereby a bottom temperature of the undershoot is above the target temperature of 185° C. as shown in FIG. 11, the heater 12 is turned off at that moment. However, since the heater off-timing is irregular, the time $\Delta t(n+2)$ which is determined by [$\Delta tn$, $\Delta cn$], [$\Delta t(n-2)$, $\Delta c(n-2)$] is again adopted as a time $\Delta t(n+4)$ for a next off-timing.

The undershoot is determined similarly to the overshoot. Upon lapse of the time $\Delta t2$, the heater 12 is turned on, whereby $\Delta c2$ is obtained. Upon lapse of the time $\Delta t4=(\frac{2}{3})t2$, the heater 12 is turned on, whereby $\Delta c4$ is obtained. The constants a2, b2 are obtained based on the data ($\Delta t2$, $\Delta c2$), ($\Delta t4$, $\Delta c4$), and a time $\Delta t6$ is obtained for a next on-timing. Thereafter, calculation to obtain data for $\Delta t(n+4)$ based on [tn, cn], [t(n+2), c(n+2)] is made repeatedly.

Similar to the overshoot, what should be taken note of in terms of the undershoot is:

(1) In the case where $\Delta tn$ is calculated to be negative, it is assumed that $\Delta tn=0$.

(2) In the case where a bottom temperature of the undershoot is above 185° C., the heater 12 is turned off at that moment. The heater on-timing is used as a starting point of the time $\Delta tn$ for a next on-timing.

Figure 12:
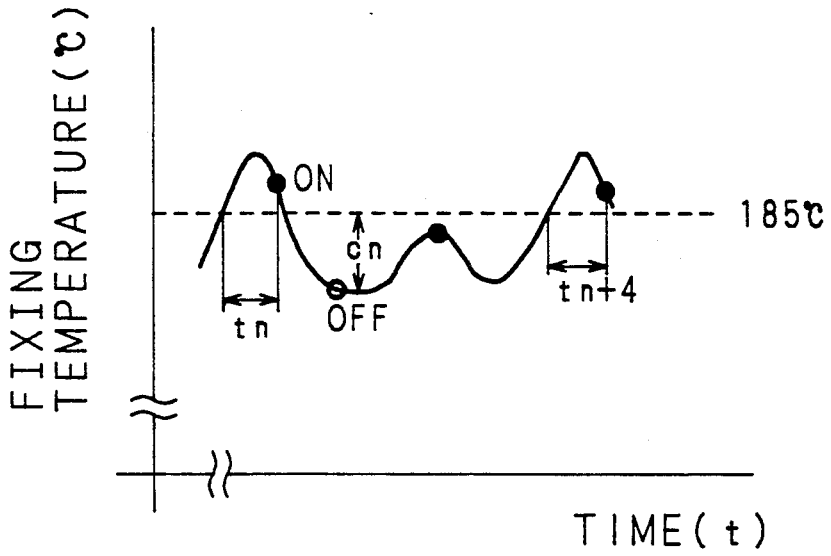
FIG. 12 is a chart showing a control in the case where the peak of the overshoot does not reach the target temperature.

(3) In the case where the heater off-timing is too early, whereby a peak temperature of the overshoot is below 185° C. as shown in FIG. 12, the time $\Delta t(n+2)$ which is determined by [$\Delta tn$, $\Delta cn$], [$\Delta t(n-2)$, $\Delta c(n-2)$] is again adopted as a time $\Delta t(n+4)$ for a next off-timing.

Figure 17:
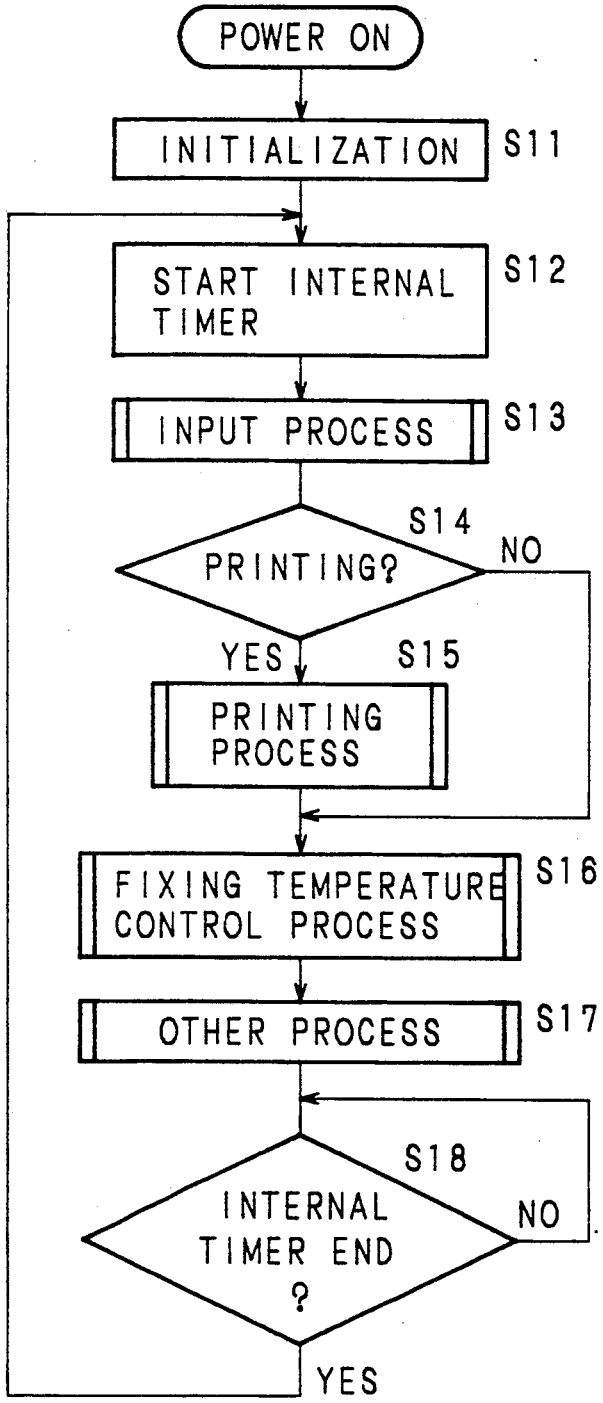
FIG. 17 is a flow chart showing a main routine of a CPU.

Next, a control procedure by the CPU 7 will be described with reference to flow charts shown in FIGS. 17 to FIG. 17 shows a main routine of the CPU 7. When the program starts upon the printer being powered on, initialization is executed such as reset of RAM in Step S11 and an internal timer starts in Step S12. In Step S13, keyed inputs from an unillustrated console panel and inputs from various sensors within the printer are processed. In Step S14, it is discriminated whether a printing operation is being performed. If the printing operation is being performed (YES in Step S14), the print operation such as feeding and transporting of the sheet, exposure, and development is carried out in Step S15, and the main routine proceeds to Step S16. If the result of discrimination in Step S14 is NO, the main routine proceeds directly to Step S16. In Step S16, a subroutine is executed in which the fixing temperature is controlled as described in detail below. Next, in Step S17, display on the console panel, a trouble processing, or other processing is executed. When completion of the internal timer is confirmed, the main routine returns to Step S12. The internal timer is adapted to determine a duration (10 msec. in this embodiment) of one execution of the main routine, and serves as a reference for a timer and a counter used in the respective subroutines.

Figure 18:
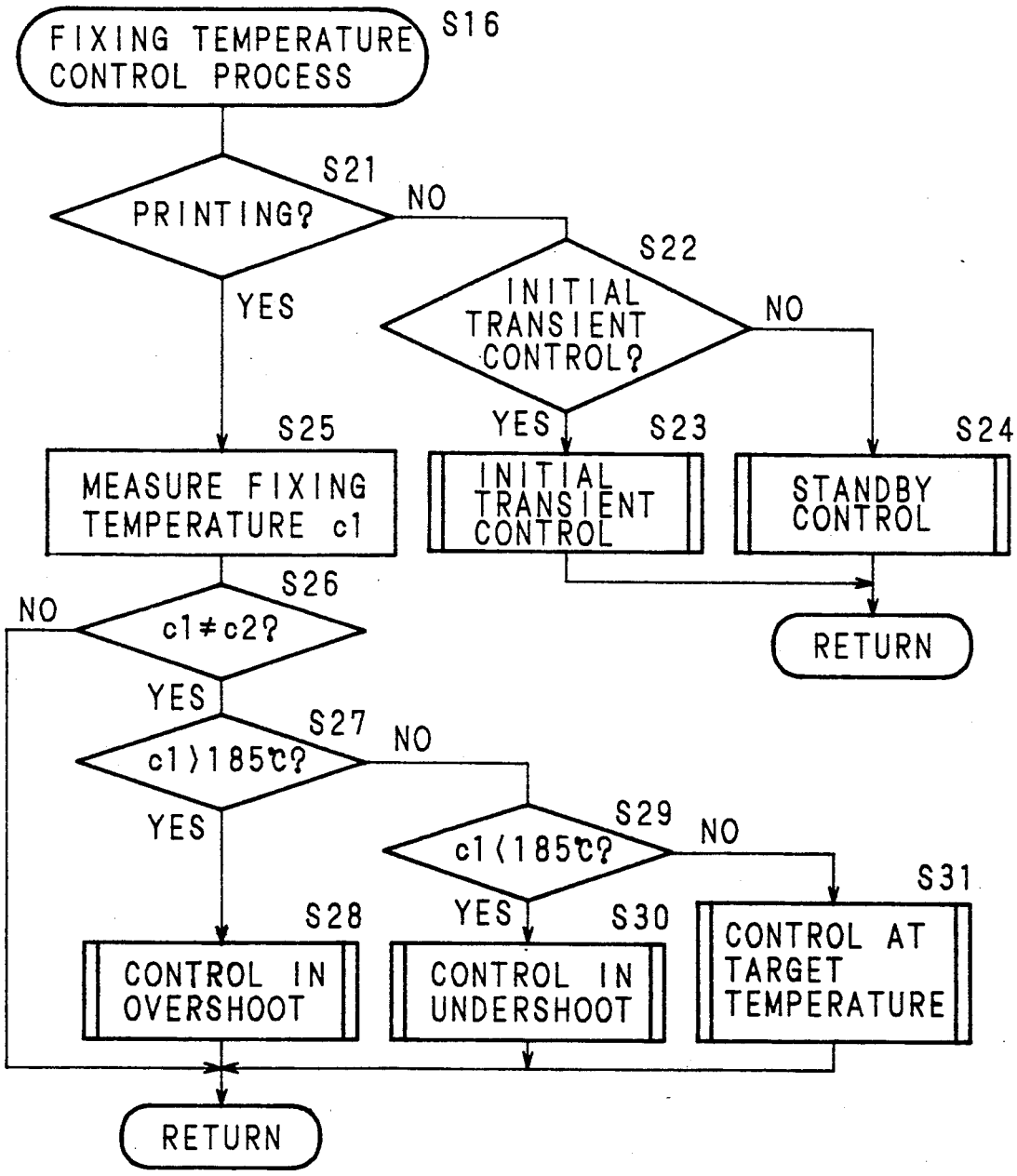
FIG. 18 is a flow chart showing a subroutine for controlling the fixing temperature.

FIG. 18 shows a subroutine of a fixing temperature control executed in Step S16.

Figure 13:
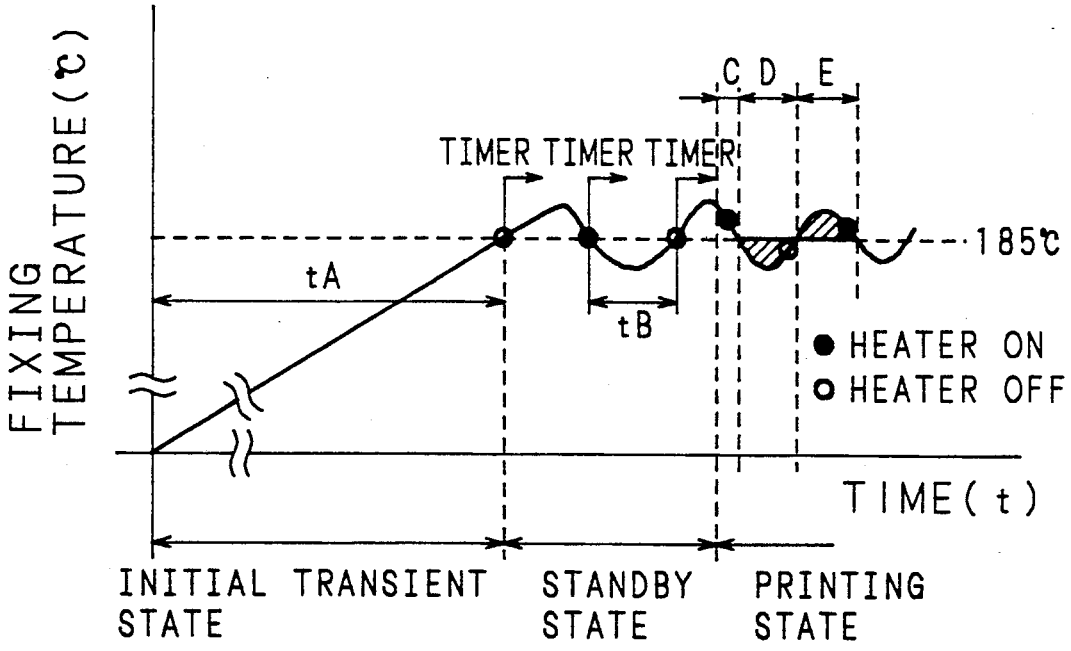
FIG. 13 is a chart showing a change in the fixing temperature, on- and off-timings of the heater, and timer start timings in a fixing temperature control.

Firstly, it is discriminated whether the printing operation is being performed in Step S21. If the printing operation is not being performed (NO in Step S21), it is discriminated whether the initial transient control is being effected in Step S22, i.e., the main switch is turned on and thereby the printer is brought into the initial transient state. The printer enters the initial transient control phase in Step S23 immediately after the main switch being turned on. More specifically, a time tA required to complete application of preheating power supply shown in FIG. 13 is measured and the external ambient temperature is estimated. Then, the fixing temperature control is effected in the printing operation immediately after the initial transient control. When the printer is standby, the standby control is executed in Step S24. In other words, the undershoot time tB in FIG. 13 is measured and the external ambient temperature is estimated. The estimated external ambient temperature is used as temperature control data in the printing operation.

On the other hand, if it is discriminated that the printing operation is being performed in Step S21, this subroutine can directly proceed to the fixing temperature control for the printing operation even in the case where the printing operation is started in a region C during the overshoot. This is because the timer used for turning on or off the heater 12 is started. The fixing temperature controls include a control at the time of overshoot executed in Step S28 (a region E in FIG. 13), a control at the time of undershoot executed in Step S30 (a region D in FIG. 13), and a control at the time when the fixing temperature is equal to the target temperature executed in Step S31.

For the above temperature controls, the current fixing temperature c1 is measured by the thermistor 13 in Step S25. In Step S26, the current fixing temperature c1 is compared with the fixing temperature c2 measured in the preceding routine. Since the duration of one routine is set at such a short period of 10 msec., the subroutine immediately returns to the main routine if c1=c2. If c1≠c2, it is discriminated whether or not the current fixing temperature c1 is higher than the target temperature of 185° C. in Step S27. If the current fixing temperature c1 is higher than the target temperature (YES in Step S27), the control at the time of overshoot is effected in Step S28. If, on the contrary, the current fixing temperature c1 is not higher than the target temperature (NO in Step S27), it is discriminated whether the fixing temperature c1 is lower than the target temperature in Step S29. If the current fixing temperature c1 is lower than the target temperature (YES in Step S29), the control at the time of undershoot is executed in Step S30. If the fixing temperature is equal to the target temperature, the control at the target temperature is executed.

Figure 19:
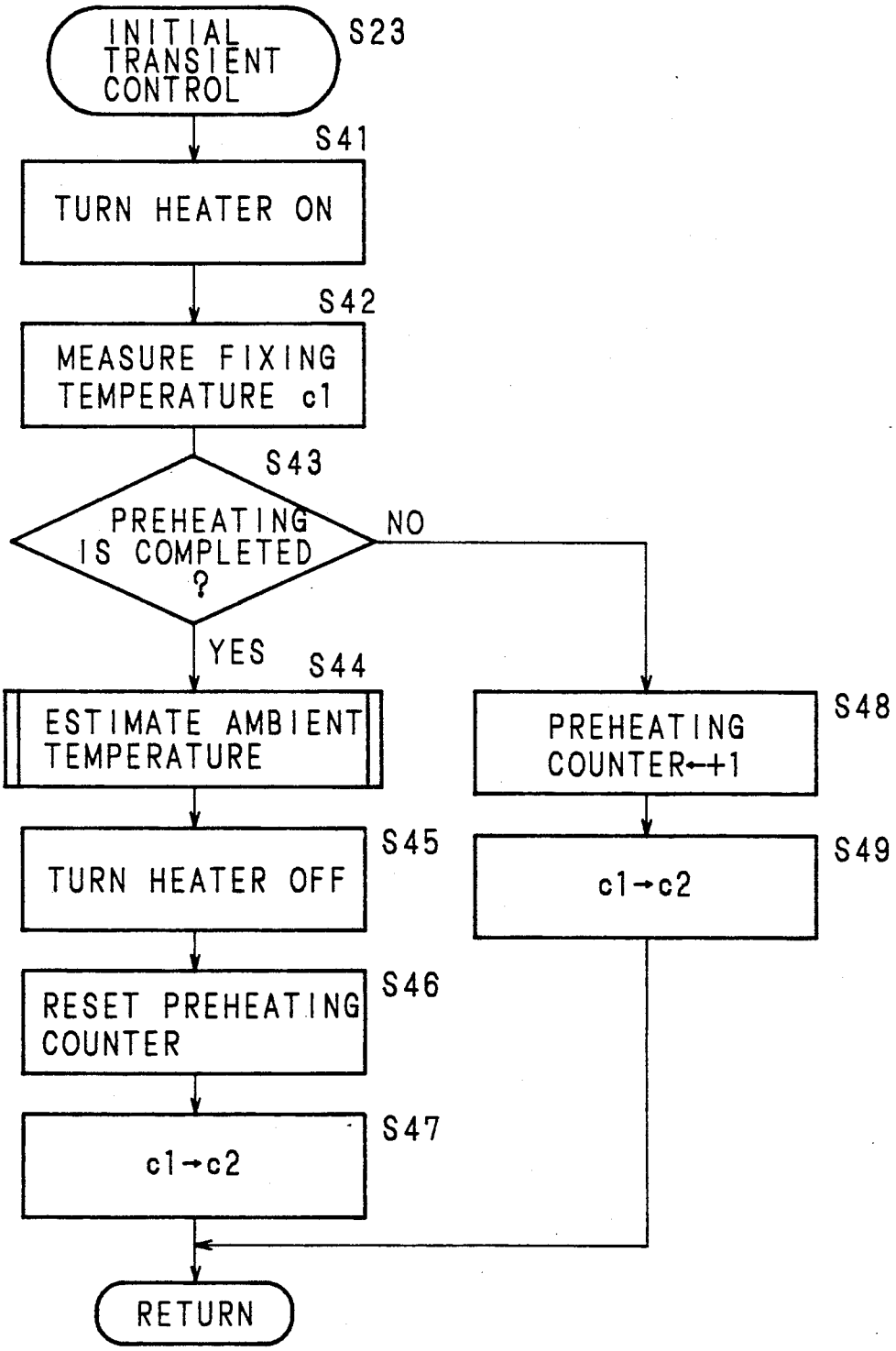
FIG. 19 is a flow chart showing a subroutine for controlling an initial preheating of the fixing unit.

FIG. 19 shows a subroutine of the initial transient control executed in Step S23.

Firstly, the heater 12 is turned on in Step S41. In Step S42, the current fixing temperature c1 is measured. Next, in Step S43, it is discriminated whether application of preheating power supply has been completed. If the application of preheating power supply has not yet completed (NO in Step S43), a preheating counter is set in Step S48 so as to count down the time required for completion of preheating power application, i.e., the fixing temperature reaches the target temperature. In Step S49, the current fixing temperature c1 is stored as temperature c2 in Step S49. Upon completion of preheating power application, a subroutine of estimating the ambient temperature is executed in Step S44 (see FIG. 20). Thereafter, the heater 12 is turned off in Step S45, and the preheating counter is reset in Step S46. Consequently, the current fixing temperature c1 is stored as temperature c2 in Step S47.

Figure 20:
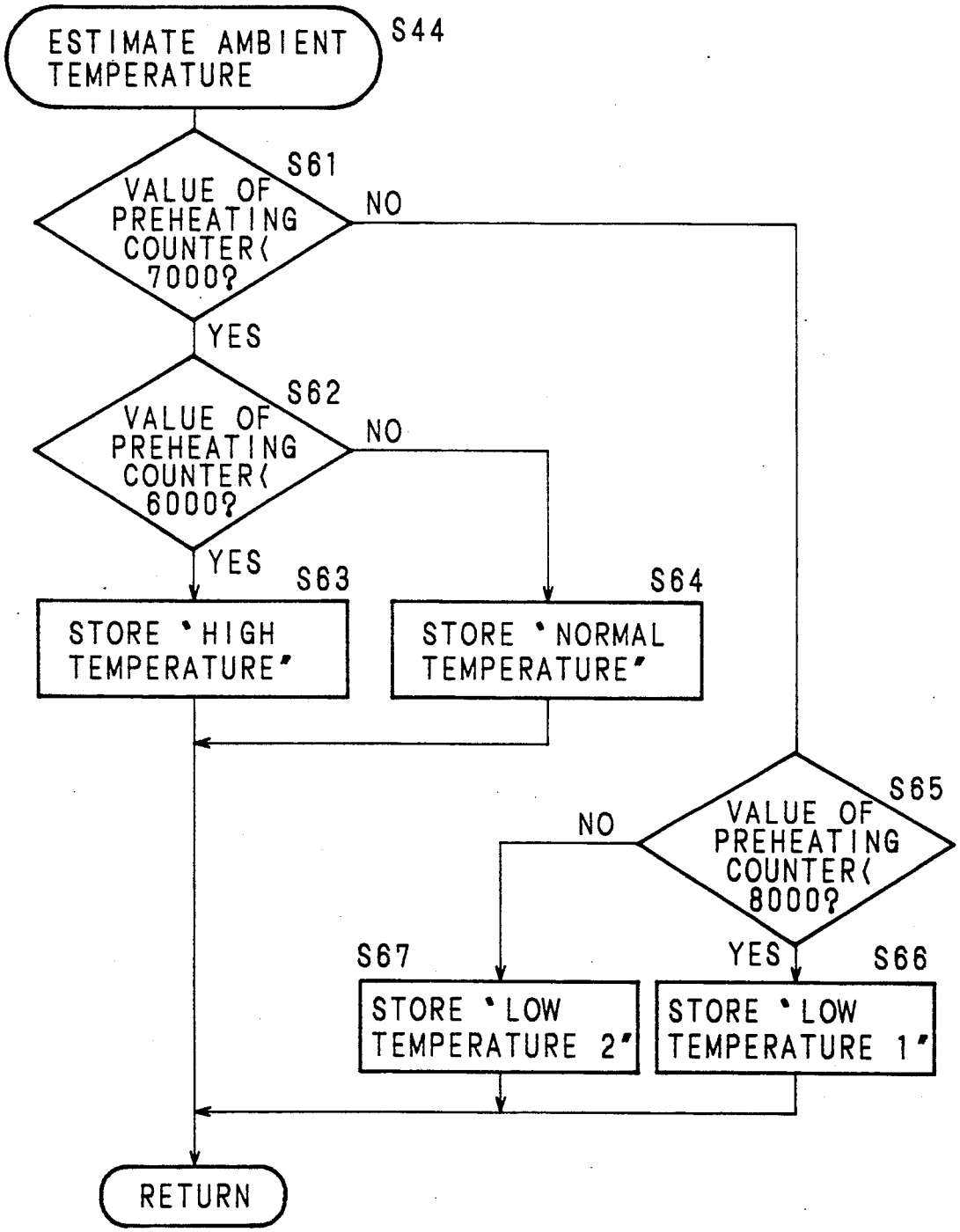
FIG. 20 is a flow chart showing a subroutine for estimating the ambient temperature.

FIG. 20 shows the subroutine of ambient temperature estimation executed in Step S44.

In this subroutine, the count value of the preheating counter is discriminated to be smaller than 7000, 6000, and 8000 respectively in Steps S61, S62, and S65. The count value is indicative of the duration of the application of preheating power supply (1 count=10 msec.), and corresponds to TABLE 1. Accordingly, if the count value is smaller than 6000, "high temperature" is stored as ambient temperature in the memory 20 in Step S63. If the count value is between 6000 and 6999, "normal temperature" is stored as ambient temperature in the memory 20 in Step S64. If the count value is between 7000 and 7999, "low temperature 1" is stored as ambient temperature in the memory 20 in Step S66. If the count value is 8000 or greater, "low temperature 2" is stored as ambient temperature in the memory 20 in Step S67.

Figure 21:
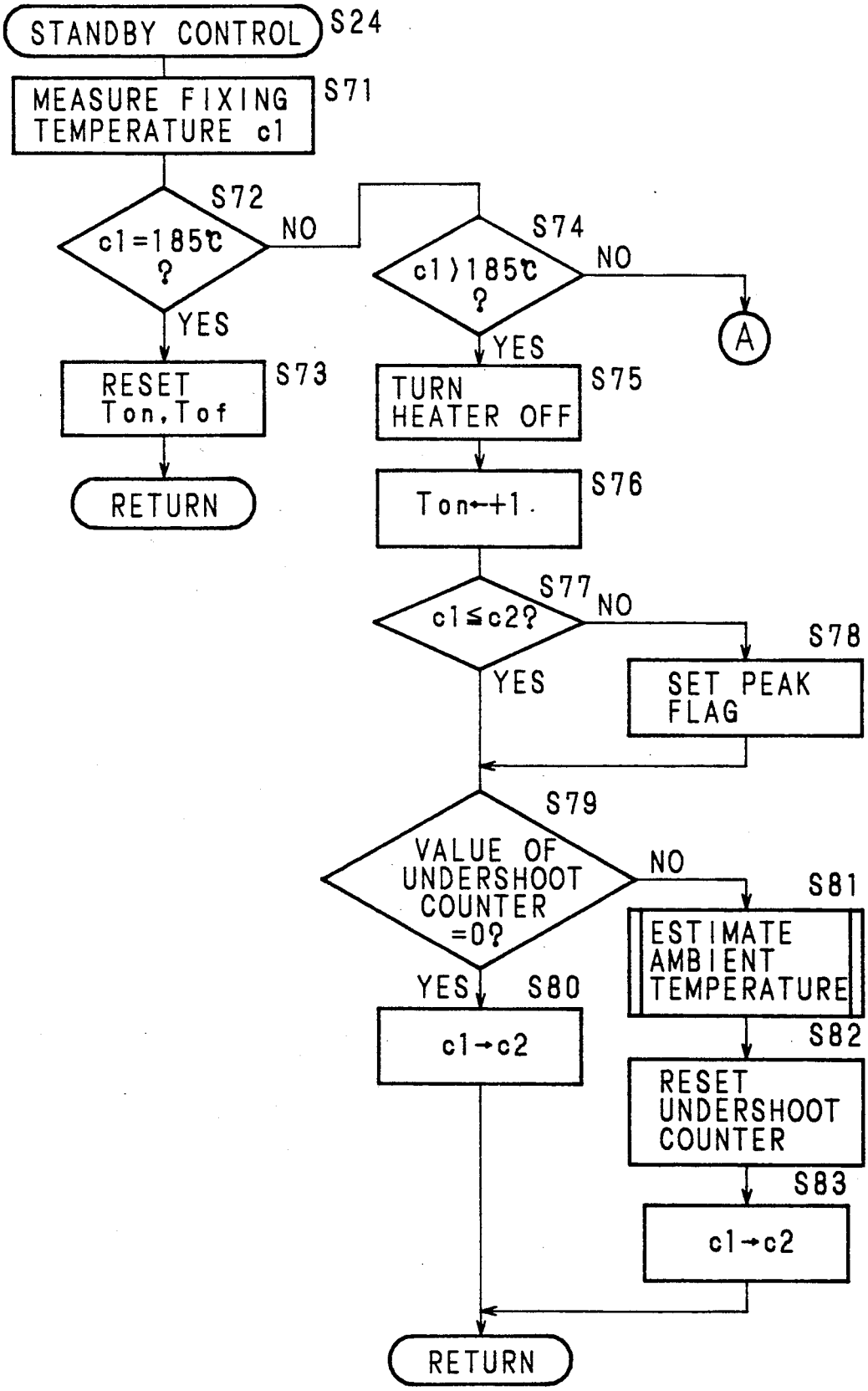
FIGS. 21, 22 are flow charts showing a subroutine for controlling the fixing temperature in the standby state.
Figure 22:
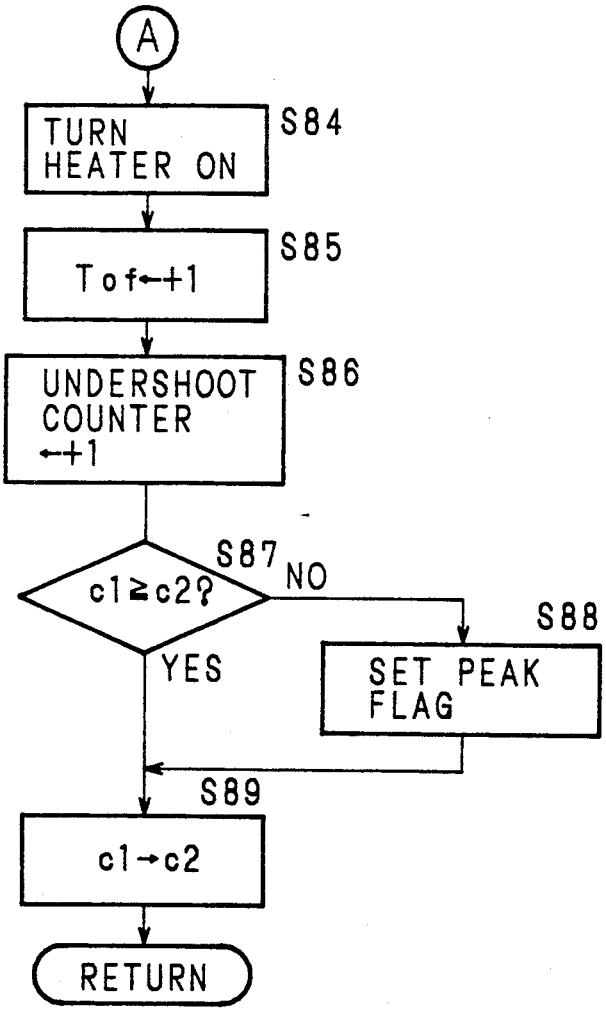

FIGS. 21, 22 show a subroutine of a control in the standby state executed in Step S24.

Figure 14:
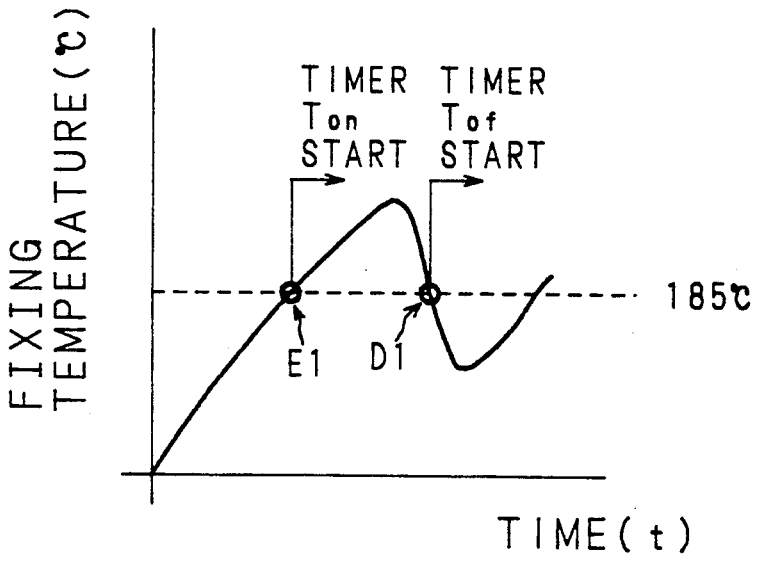
FIG. 14 is a chart showing a change in the fixing temperature, on- and off-timings of the heater, and timer start timings in a fixing temperature control.

The purpose of this subroutine is to on-off control the heater 12 so as to maintain the fixing temperature at 185° C. in the standby state, measure the undershoot time, and estimate the ambient temperature based on the measured undershoot time, and determine on-, and off-timings of the heater during the copying operation. The on-, and off-timings are determined by timers Ton, and Tof respectively. As shown in FIG. 14, the timer Ton is started from an overshoot starting point E1, and the timer Tof is started from an undershoot starting point D1.

Firstly, the current fixing temperature c1 is measured in Step S71. In Step S72, it is discriminated whether the temperature c1 is equal to 185° C. If the temperature c1 is equal to 185° C. (YES in Step S72), it indicates either the starting point D1 or E1. Accordingly, the timer Ton, or Tof is reset in Step S73. If the temperature c1 is not equal to 185° C. (NO in Step S72), it is discriminated whether the temperature c1 is higher than 185° C. in Step S74. If the temperature c1 is higher than 185° C. (YES in Step S74), the heater 12 is turned off in Step S75, and the timer Ton is caused to start counting in Step S76. Subsequently, the current fixing temperature c1 is compared with the fixing temperature c2 measured in the preceding routine in Step S77. If c1>c2, it means the fixing temperature has passed a lower limit of the undershoot, and therefore a peak flag is set in Step S78. The peak flag is adapted to determine where the current temperature lies in the fixing temperature curve.

After the processing in Step S78 or if c2≧c1 (YES in Step 77), it is discriminated whether the count value of the undershoot counter is 0 in Step S79 (counting is executed in Step 86 in FIG. 22). If the count value is not 0 (NO in Step S79), the ambient temperature is estimated based on the count value in Step S81. Subsequently, the undershoot counter is reset in Step S82, and the current fixing temperature c1 is stored as temperature c2 in Step S83. If the count value is 0 (YES in Step S79), the current fixing temperature c1 is stored as temperature c2 in Step S80 similarly to Step S83.

On the other hand, if the fixing temperature c1 is not higher than 185° C. (NO in Step S74), the heater 12 is turned on in Step S84. In Step S85, the timer Tof is caused to start counting, and in Step S86 the undershoot counter is caused to start counting. More specifically, the time during which the fixing temperature is not higher than 185° C. is measured in Step S86. Subsequently, the current fixing temperature c1 is compared with the temperature c2 measured in the preceding routine in Step S87. If c1<c2, the peak flag is set in Step S88. If c1≧c2, the subroutine proceeds directly to Step S89 in which the current fixing temperature c1 is stored as temperature c2.

Figure 23:
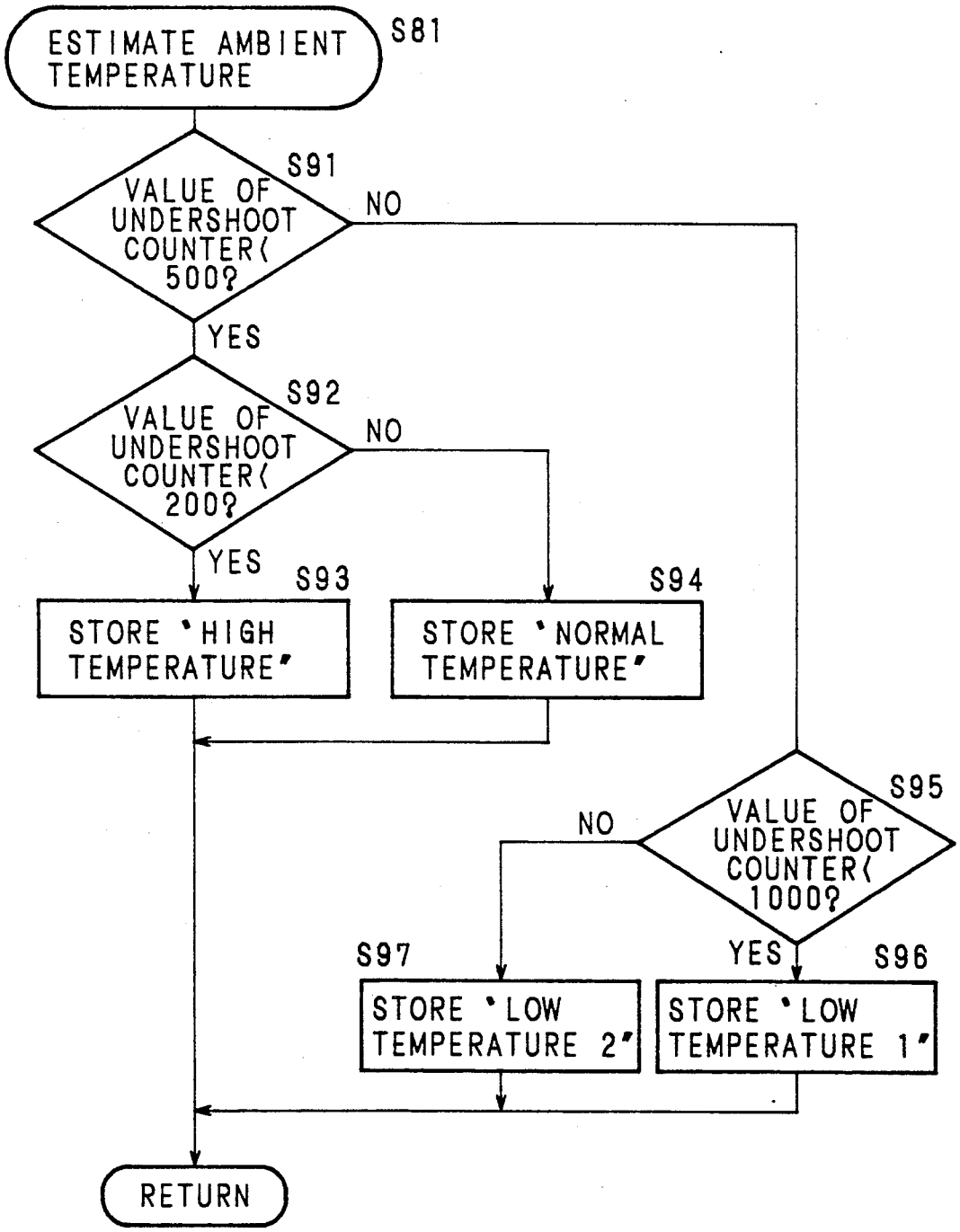
FIG. 23 is a flow chart showing a subroutine for estimating the ambient temperature.

FIG. 23 shows a subroutine of the ambient temperature estimation executed in Step S81.

In this subroutine, the count value of the undershoot counter is discriminated to be smaller than 200, 500, and 1000 respectively in Steps S91, S92, and S95. The count value is indicative of the undershoot time (1 count=10 msec.), and corresponds to TABLE 1. Accordingly, if the count value is smaller than 200, "high temperature" is stored as ambient temperature in the memory 20 in Step S93. If the count value is between 200 and 499, "normal temperature" is stored as ambient temperature in the memory 20 in Step S94. If the count value is between 500 and 999, "low temperature 1" is stored as ambient temperature in the memory 20 in Step S96. If the count value is 1000 or more, "low temperature 2" is stored as ambient temperature in the memory 20 in Step S97.

Figure 24:
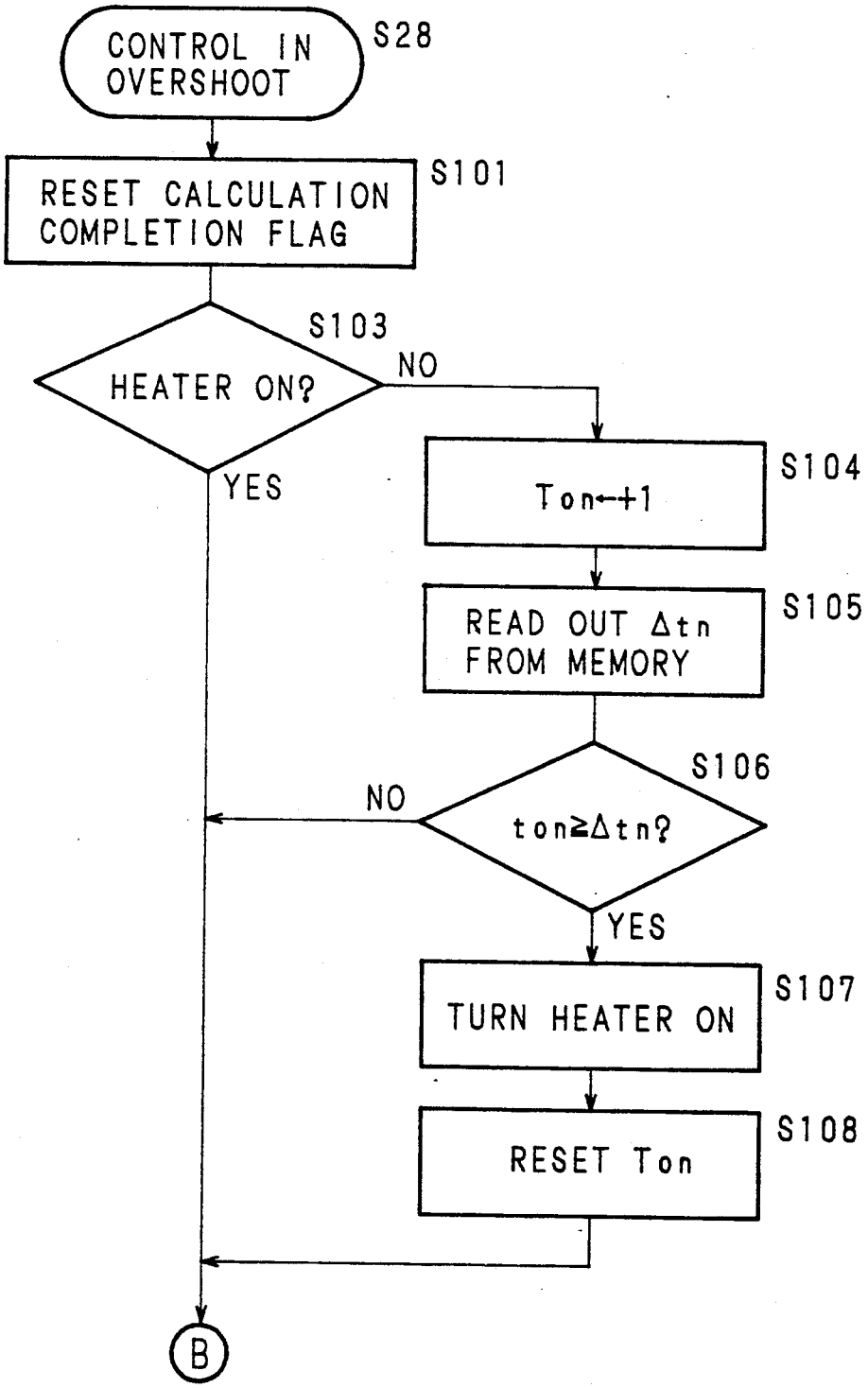
FIGS. 24, 25 are flow charts showing a subroutine for a control at the time of overshoot.
Figure 25:
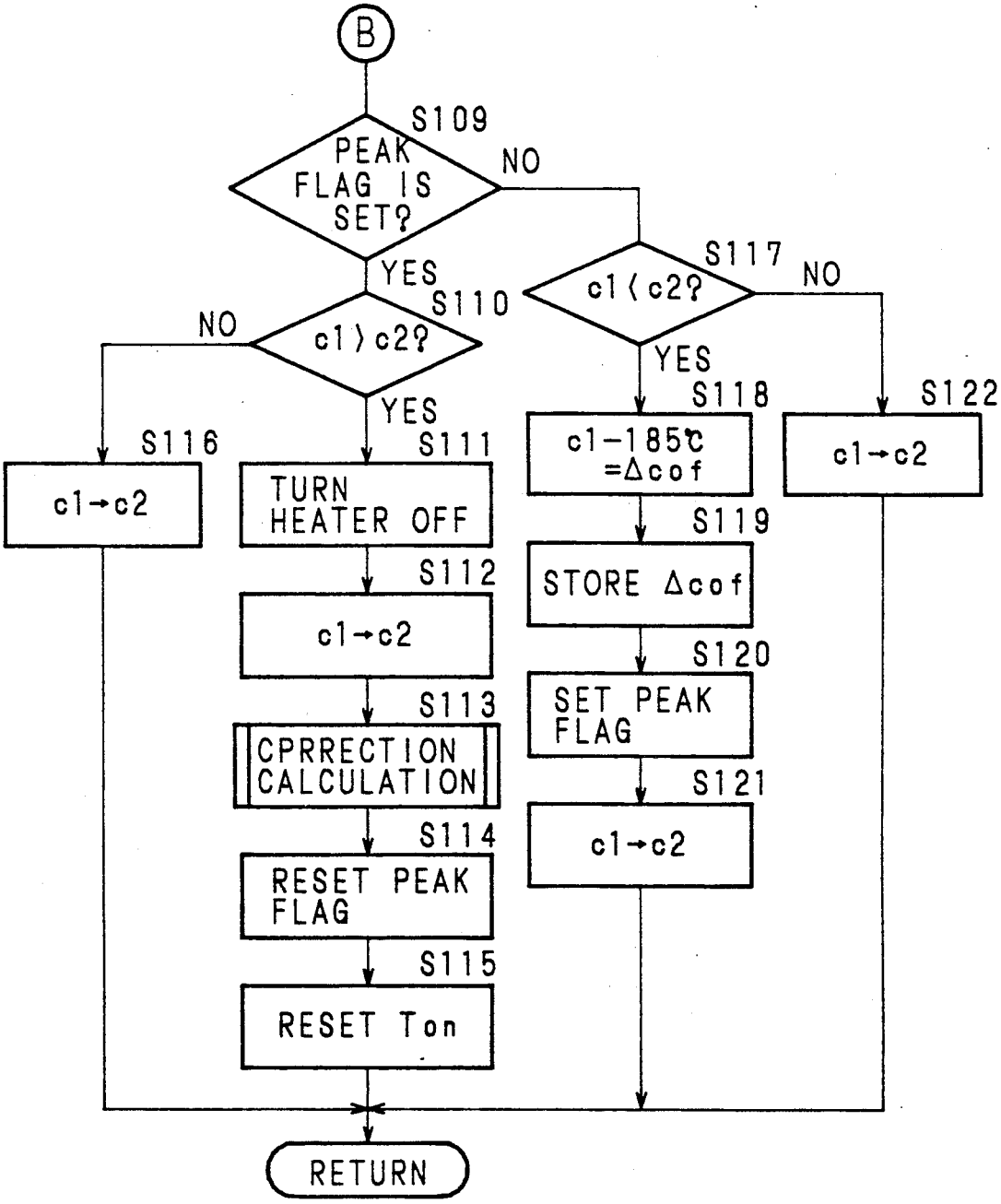

FIGS. 24, 25 show a subroutine of a control at the time of overshoot which is executed in Step S28. This subroutine will be described with reference to a graph showing temperature changes in FIG. 15.

Firstly, a flag indicative of completion of calculations (calculation completion flag) is reset in Step S101, and it is discriminated whether the heater 12 is on in Step S103. Initially, the result of discrimination in Step S103 is NO since the heater 12 is off, and the subroutine proceeds to Step S104 in which the timer Ton is caused to start counting. In Step S105, the data Δtn for a proper heater on-timing is read out from the memory 20. Subsequently, the count value ton of the timer Ton is compared with the data Δtn in Step S106. If the count value ton has not reached the data Δtn, the subroutine proceeds to Step S109 in which it is discriminated whether the peak flag is set. In the case where the peak of the overshoot has been reached, a processing in Steps S110 to S116 is executed. In the case where the peak of the overshoot has not been reached, a processing in Steps S117 to S122 is executed. The peak of the overshoot has not been reached yet initially, and accordingly the current fixing temperature c1 is compared with the fixing temperature c2 measured in the preceding routine. During the time when the temperature is still on the increase, the temperature c1 is stored as temperature c2 in Step S122. When the count value ton of the timer Ton becomes equal to the data Δtn (YES in Step S106) while the these Steps are repeated, the heater 12 is turned on in Step S107 (see FIG. 15(*a*)), and the timer Ton is reset in Step S108.

On the other hand, in the case where the current fixing temperature c1 reaches c2, i.e., the peak of the overshoot is reached (YES in Step S117), before the count value ton of the timer Ton becomes equal to the data Δtn, a peak value Δcof is calculated by subtracting 185 from the fixing temperature c1 in Step S118. The calculated peak value Δcof is stored in the memory 20 in Step S119. Simultaneously, the peak flag is set in Step S120, and the current fixing temperature c1 is stored as temperature c2 in Step S121. Thereafter, if the result of discrimination is YES in Step S109, the fixing temperature c1 is stored as temperature c2 in Step S116 while the temperature is still on the decrease. When the count value ton of the timer Ton becomes equal to the data Δtn (YES in Step S106) during the time when these Steps are being repeated in this way, the heater 12 is turned on in Step S107 (see FIG. 15(*b*)), and the timer Ton is reset in Step S108.

Upon the heater 12 being turned on, a processing of Steps S103, S109, S110, and S116 is repeated hereafter until the fixing temperature falls below 185° C.

Figure 15A:
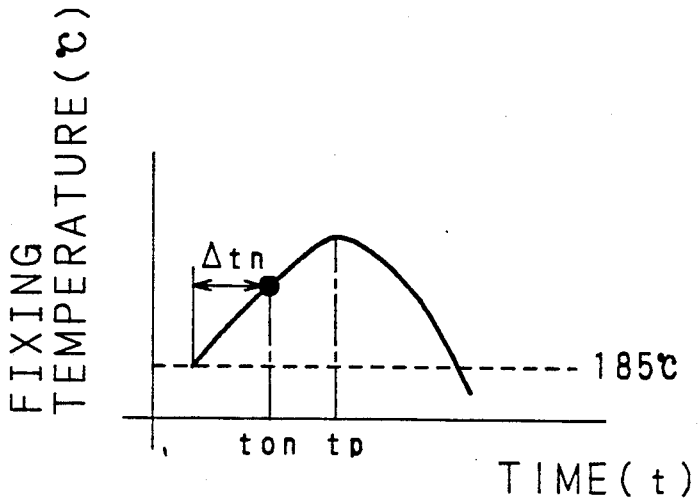
FIGS. 15(*a*), 15(*b*), and 15(*c*) are charts respectively showing a change in the fixing temperature, on- and off-timings of the heater, and timer start timings in a fixing temperature control.
Figure 15B:
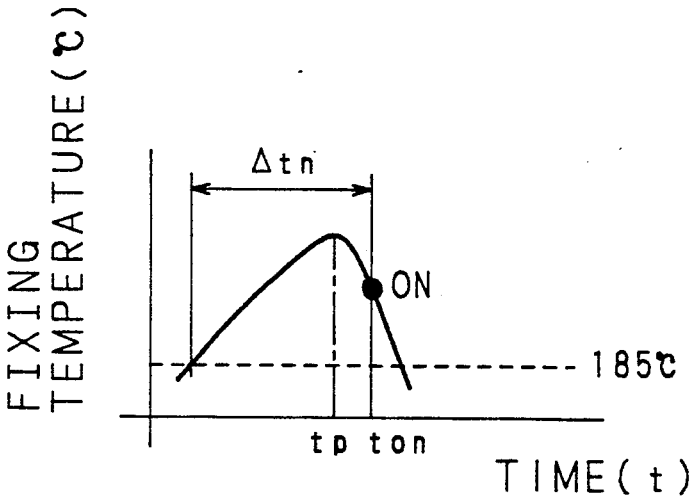
Figure 15C:
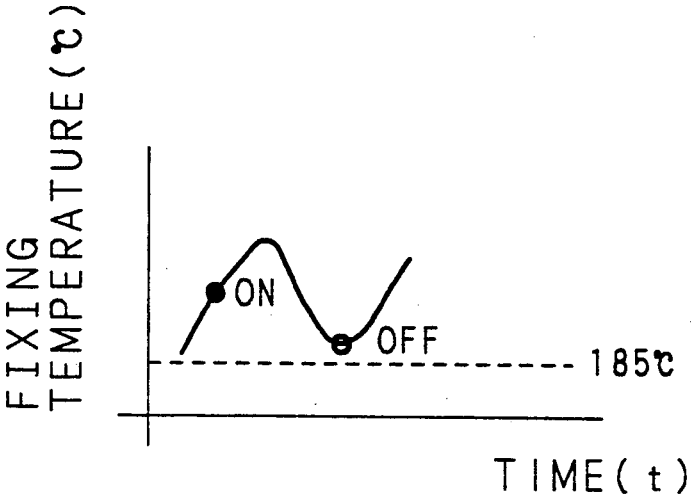

As shown in FIG. 15(*c*), in the case where the fixing temperature does not fall to 185° C., i.e., the heater 12 is turned on, the fixing temperature reaches the peak of the overshoot and starts increasing (YES in Step S110), the heater 12 is turned off in Step S111. In Step S112, the current fixing temperature c1 is stored as temperature c2, and the value of Δtn is calculated so as to determine the next heater on-timing and the temperature control pattern is corrected in Step S113. A subroutine of this correction calculation will be described in detail later with reference to FIGS. 29, 30. Thereafter, in Step S114, the peak flag is reset, and in Step S115 the timer Ton is reset, whereby causing it to start counting from 1.

Figure 26:
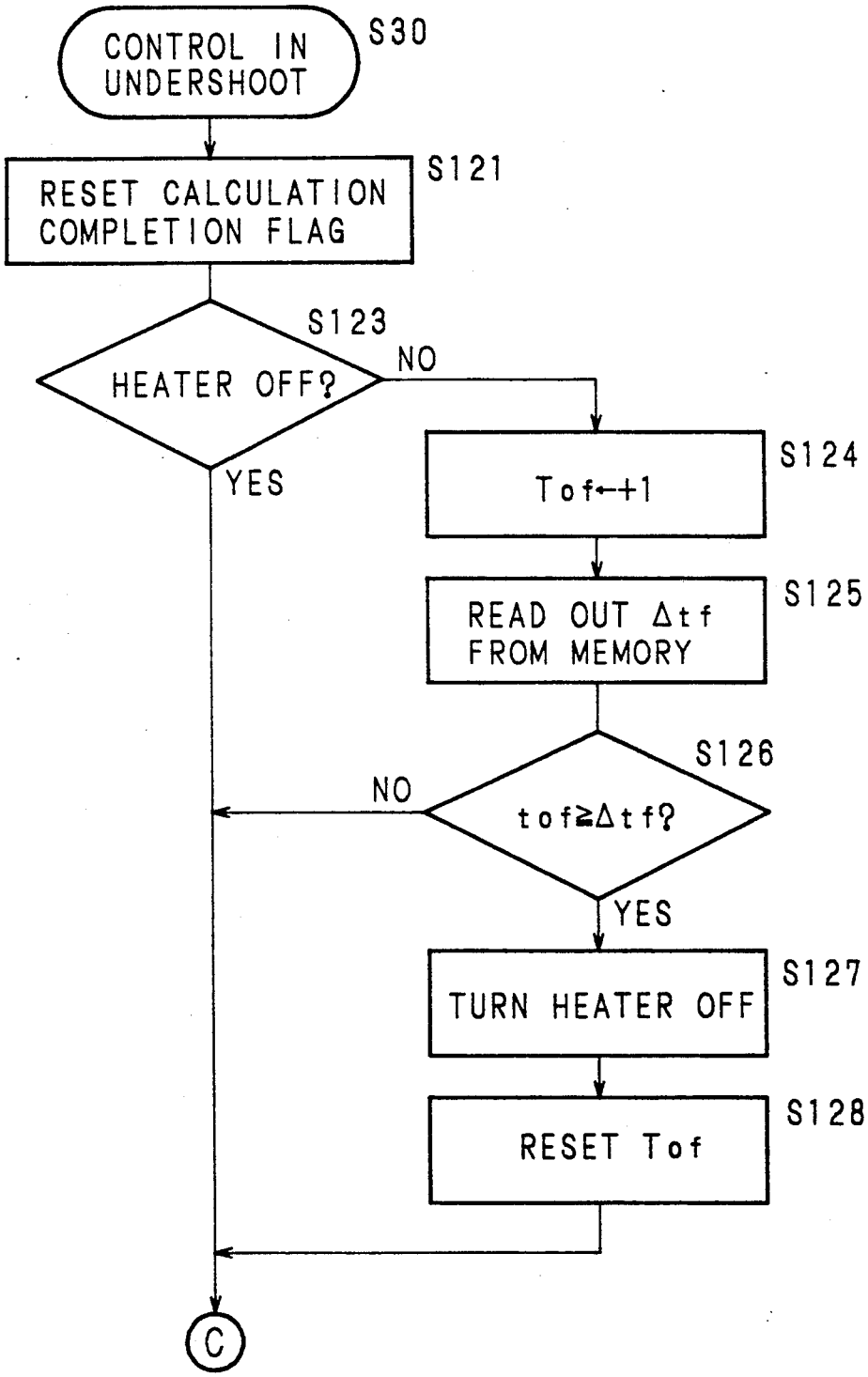
FIGS. 26, 27 are flow charts showing a subroutine for a control at the time of undershoot.
Figure 27:
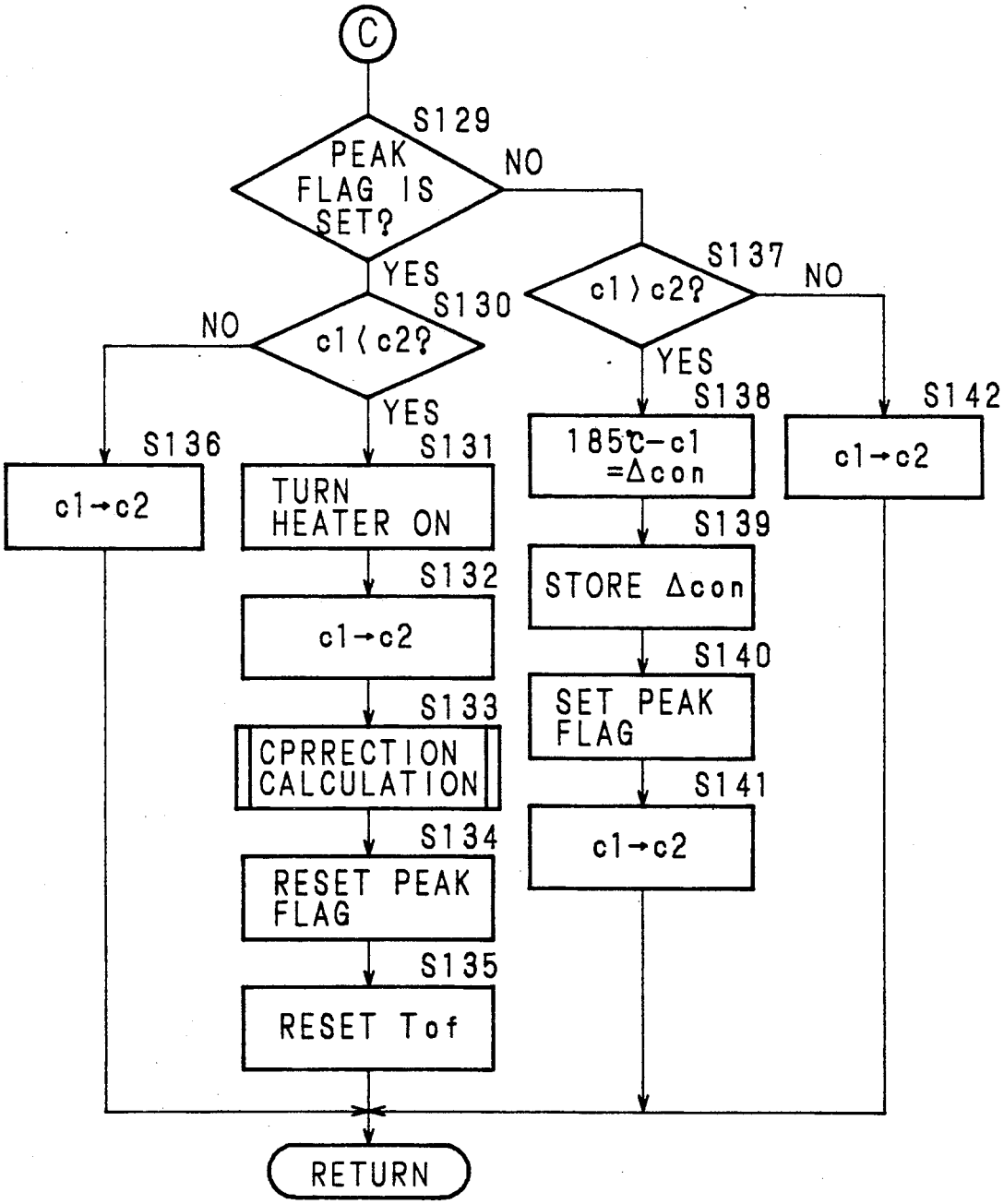

FIGS. 26, 27 are flow charts showing a subroutine of a control at the time of undershoot executed in Step S30. This subroutine will be described with reference to a graph showing temperature variations in FIG. 16.

Firstly, the calculation completion flag is reset in Step S121, and it is discriminated whether the heater 12 is turned off in Step S123. Initially, the result of discrimination in Step S123 is NO since the heater 12 is on. Accordingly, the subroutine proceeds to Step S124 in which the timer Tof is caused to start counting. In Step S125, data Δtf for a proper heater off-timing is read out from the memory 20. Subsequently, in Step S126, a count value tof of the timer Tof is compared with the data Δtf. If the count value tof has not reached the data Δtf, i.e., tof < Δtf, the subroutine proceeds to Step S129. In Step S129, it is discriminated whether the peak flag is set. If the bottom of the undershoot has been passed, a processing of Steps S130 to S136 is executed. If the bottom of the undershoot has not yet been passed, a processing of Steps S137 to S142 is executed. Initially, the bottom of the undershoot has not been reached, and accordingly the current fixing temperature c1 is compared with the fixing temperature c2 measured in the preceding routine in Step S137. The current fixing temperature c1 is stored as temperature c2 in Step S142 while the fixing temperature is on the decrease. When the count value tof of the timer Tof becomes equal to the data Δtf (YES in Step S126) during the time when these Steps are repeated, the heater 12 is turned off in Step S127 (see FIG. 16(*a*)). In Step S128, the timer Tof is reset.

On the other hand, in the case where the current fixing temperature c1 reaches c2, i.e., the bottom of the undershoot is reached (YES in Step S137) before the count value tof of the timer Tof becomes equal to Δtf, the bottom value Δcon is calculated by subtracting the fixing temperature c1 from 185 in Step S138. The calculated bottom value Δcon is stored in the memory 20 in Step S139. Simultaneously, the peak flag is set in Step S140, and the current fixing temperature c1 is stored as temperature c2 in Step S141. Thereafter, the result of discrimination in Step S129 is YES, and accordingly the fixing temperature c1 is stored as temperature c2 in Step S136 while the fixing temperature is on the increase. When the count value tof of the timer Tof becomes equal to the data Δtf (YES in Step S126) during the time when these Steps are repeated, the heater 12 is turned off in Step S127 (see FIG. 16(*b*)). In Step S128, the timer Tof is reset.

After the heater 12 is turned off, it is waited until the fixing temperature reaches 185° C. by repeating Steps S123, S129, S130, S136.

Figure 16A:
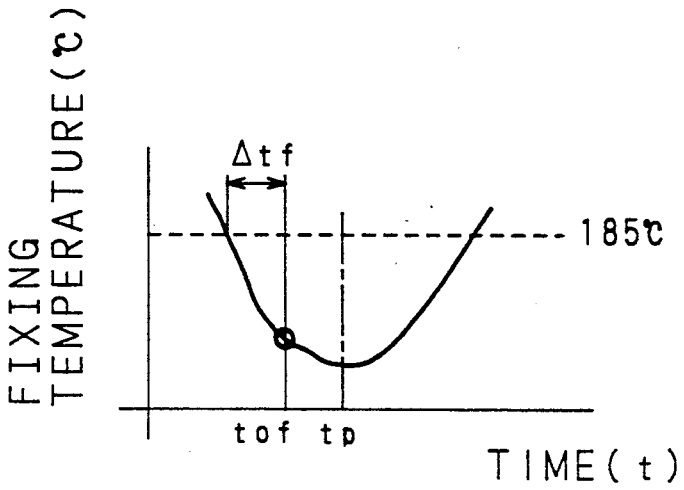
FIGS. 16(*a*), 16(*b*), and 16(*c*) are charts respectively showing a change in the fixing temperature, on- and off-timings of the heater, and timer start timings in a fixing temperature control.
Figure 16B:
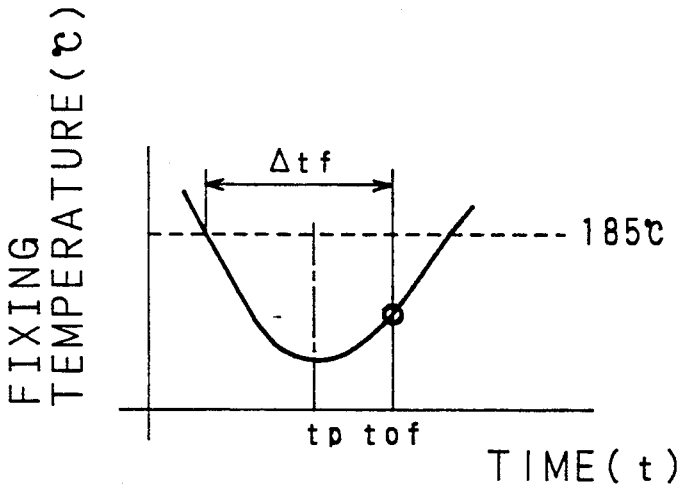
Figure 16C:
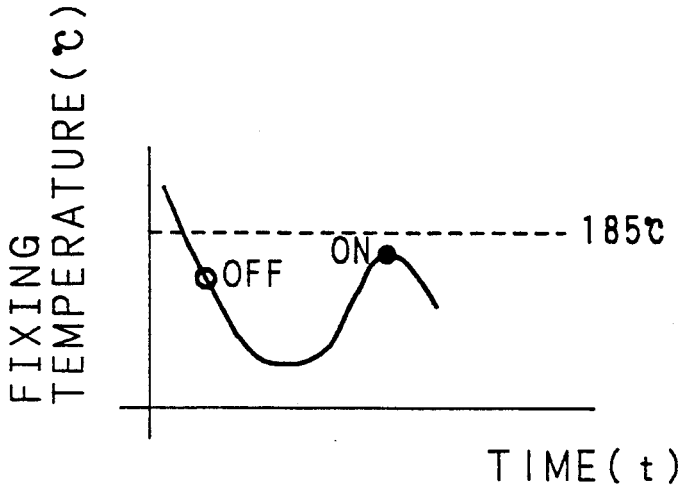

As shown in FIG. 16(*c*), in the case where the fixing temperature does not reach 185° C., i.e., the heater 12 is turned off and the fixing temperature passes the bottom of the undershoot and starts decreasing (YES in Step S130), the heater 12 is turned on in Step S131. Further, the current fixing temperature c1 is stored as temperature c2 in Step S132, and the value Δtf is calculated so as to determine the next heater off-timing and the temperature control pattern is corrected based on the calculated value Δtf in step S133. A subroutine of this correction calculation will be described in detail with reference to FIGS. 29, 30. Thereafter, the peak flag is reset in Step S134, and, in step S135, the timer Tof is reset, whereby causing it to start counting from 1.

Figure 28:
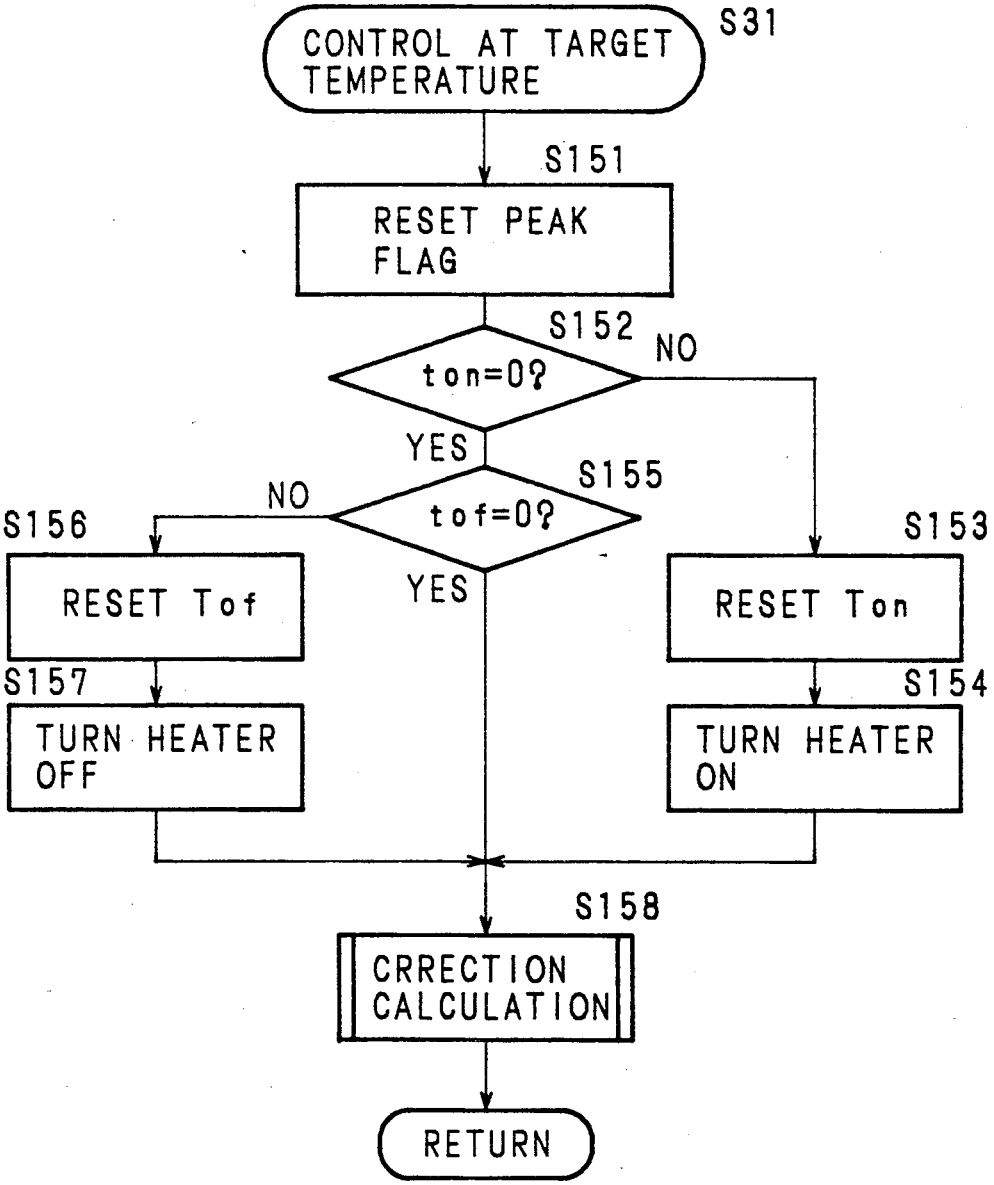
FIG. 28 is a flow chart showing a subroutine for a control at the target temperature.

FIG. 28 is a flow chart showing a subroutine of a control executed in Step S31 at the target temperature.

Figure 29:
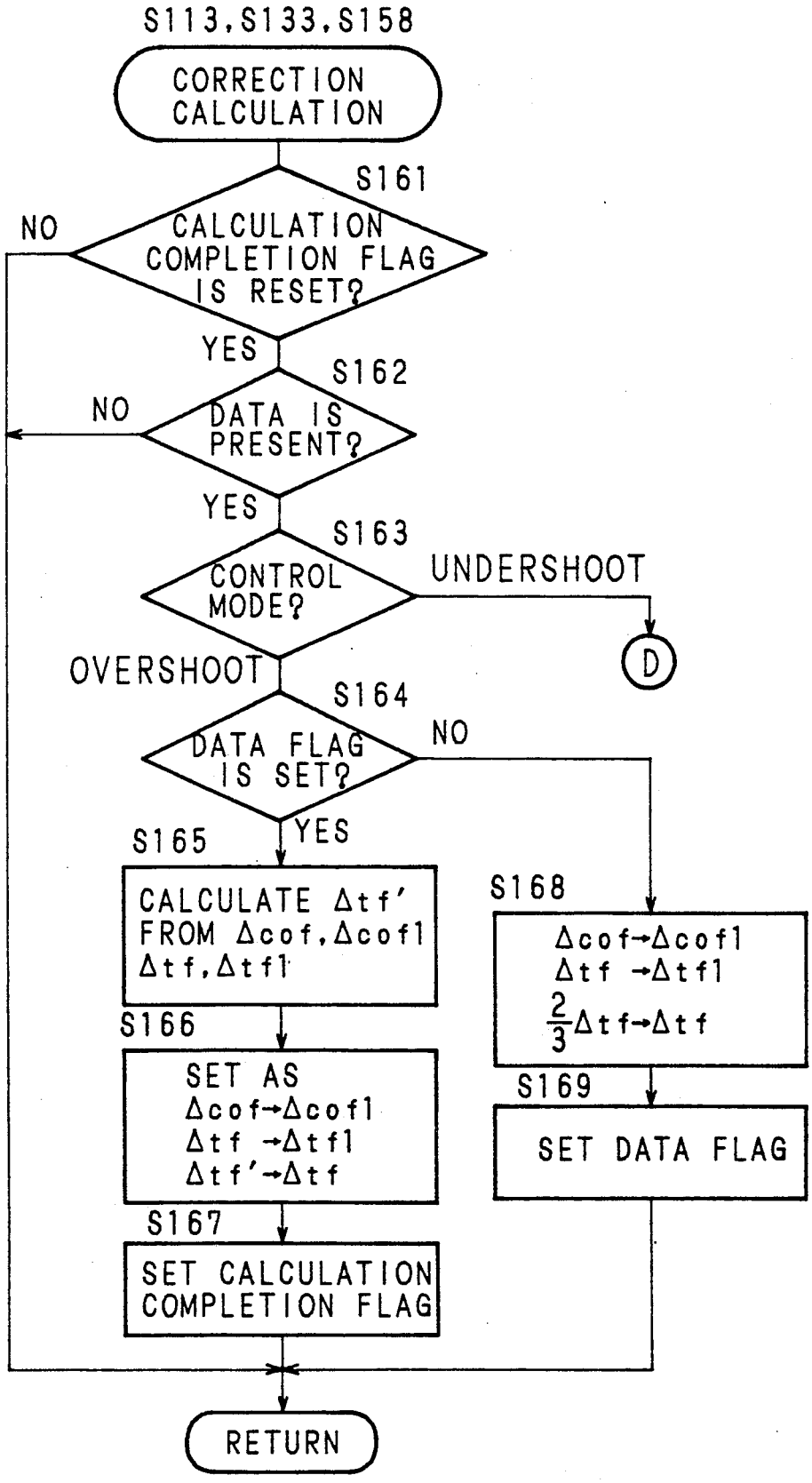
FIGS. 29, 30 are flow charts showing a subroutine for executing a correction calculation.
Figure 30:
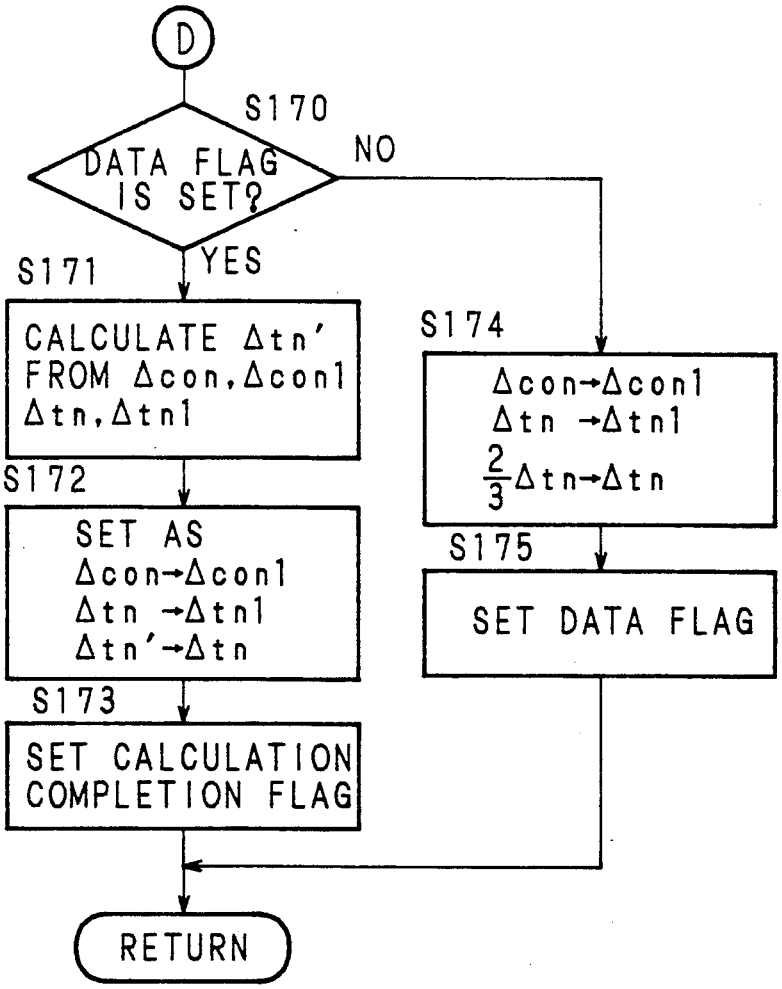

This subroutine is called upon the fixing temperature reaching the target temperature. Firstly, the peak flag is reset in Step S151. Subsequently, it is discriminated whether count values ton, tof of the timers Ton, Tof are 0 in Steps S152, S155 respectively. If both count values ton, tof are 0, this subroutine proceeds directly to Step S158. If the count value ton is not 0, the timer Ton is reset in Step S153. If the count value ton is 0, but the count value tof is not 0, the timer Tof is reset in Step S156. During the time when the timer Ton is counting, the heater 12 is off despite the fact that the fixing temperature is required to decrease below 185° C. Accordingly, the heater 12 is turned on in Step S154, and the subroutine proceeds to Step S158. During the time when the timer Tof is counting, the heater 12 is off despite the fact that the fixing temperature is required to increase above 185° C. Accordingly, the heater 12 is turned off in Step S157, and the subroutine proceeds to Step S158. In Step S158, the correction calculation to be described hereinafter is processed, FIGS. 29, 30 are flow charts showing the subroutine of correction calculation control executed in Steps S113, S133, S158.

Firstly, it is discriminated whether the calculation completion flag is reset in Step S161. In Step S162, there is discriminated the presence or absence of the data to be calculated. In the case where the calculation has been completed or the absence of the data to be calculated is discriminated, this subroutine is completed immediately.

In the case where the presence of the data to be calculated is discriminated, a control mode is checked in Step S163. In the case of an overshoot control mode, the next heater off-time is calculated in Steps S164 to S169. In the case of an undershoot control mode, the heater on-time is calculated in Steps S170 to S175.

In the case of the overshoot control mode, since only one pair of data is available initially, the data flag has already been reset (NO in Step S164). In Step S168, the data Δtf is tentatively set at (⅔)Δtf. Simultaneously, Δcof1, Δtf1 are respectively set at Δcof, Δtf. Subsequently, the data flag is set in Step S169. Next time this subroutine is called, the result of discrimination in Step S164 is YES, and the next off-time Δtf' is calculated from the latest data (Δtf, Δcof) and the previous data (Δtf1, Δcof1) with the use of equations (2), (3), (4), and the calculated off-time Δtf' is stored in the memory 20 in Step S165. Thereafter, the latest data (Δtf, Δcof) is set as data (Δtf1, Δcof1), the calculation result Δtf' is set as Δtf and stored in the memory 20 in Step S166. Further, in Step S167, the calculation completion flag is set, whereby this subroutine is completed.

In the case of the overshoot control mode as well, the processing is executed which is basically similar to that executed in the overshoot control mode so as to calculate the next heater on-time. More specifically, Δtn is set as (⅔)Δtn in Step S173 in the first routine, and the next on-time Δtn' is calculated from the data (Δtn, Δcon), (Δtn1, Δcon1) and calculated on-time is stored in the memory 20 in Step S171 in the second and subsequent routines.

It should be understood that the on-time Δtn' and off-time Δtf' are assumed to be 0 in the case where they are negative in any calculation processing.

SECOND EMBODIMENT

A second embodiment will be described with reference to FIGS. 31 to 36. The first embodiment is directed to a temperature control which is effected so as to maintain the fixing temperature at a fixed level as much as possible by approximating the amplitude of overshoot and undershoot of the fixing temperature to 0. On the contrary, the second embodiment is directed to a temperature control which is effected so as to maintain the fixing temperature at a fixed level as much as possible by approximating the response of the fixing temperature, i.e., the overshoot time and undershoot time, to 0. The apparatus and device shown in FIGS. 1, 2 are employed in this embodiment. A concept of this control is similar to the one shown with reference to the flow chart in FIG. 4 except that next heater on-, or off-timing is calculated on the basis of the overshoot or undershoot time in Step S6.

Figure 31:
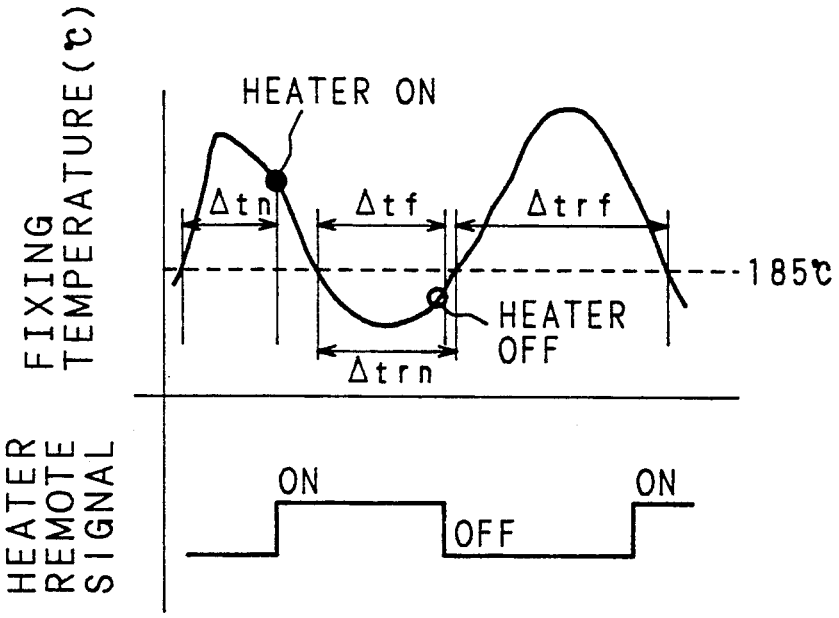
FIG. 31 is a chart showing a response of the fixing temperature relative to an on-state and an off-state of the heater.

Response of the fixing temperature is obtained by measuring the time during which the fixing temperature changes in a specified manner after the heater 12 is turned on or off. In the second embodiment, as shown in FIG. 31, when the heater 12 is turned on, a response time is defined as time Δtrn which starts when the fixing temperature falls below the target temperature of 185° C. and ends when it rises above the target temperature again. Further, when the heater 12 is turned off, a response time is defined as time Δtrf which starts when the fixing temperature rises above the target temperature of 185° C. and ends when it falls below the target temperature again.

The heater on-timing Δtn is determined by starting a timer upon the fixing temperature reaching 185° C. The response time Δtrn is influenced by the ambient temperature, sheet size, or the like as described above. The response time Δtrn is a function of Δtn, and defined as a linear function: Δtrn = aΔtn + b.

If two pairs of data (Δtn, Δtrn), (Δtn1, Δtrn1) are obtained, constants a, b can be calculated using the equations (5), (6).

$$a=(\Delta trn-\Delta trn1)/(\Delta tn-\Delta tn1) \quad (6)$$

$$b=\Delta trn-\Delta tn\times(\Delta trn-\Delta trn1)/(\Delta tn-\Delta tn1) \quad (7)$$

Since the purpose of this control is to approximate Δtrn to 0, the next heater on-time is defined as follows.

$$\Delta tn=-b/a \quad (8)$$

Similarly, the heater off-time is defined as follows.

$$a=(\Delta trf-\Delta trf1)/(\Delta tf-\Delta tf1) \quad (9)$$

$$b=\Delta trf-\Delta tf\times(\Delta trf-\Delta trf1)/(\Delta tf-\Delta tf1) \quad (10)$$

$$\Delta tf=-b/a \quad (11)$$

Next there will be described a control procedure by the CPU.

The control procedure is similar to the one described with reference to FIGS. 17 to 30 in the first embodiment except for the following points.

It does not particularly matter the peak of the overshoot and the bottom of the undershoot in the temperature control in the standby state shown in FIGS. 21, 22 in the second embodiment. Accordingly, Steps S77, S78, S87, S88 are omitted.

Figure 32:
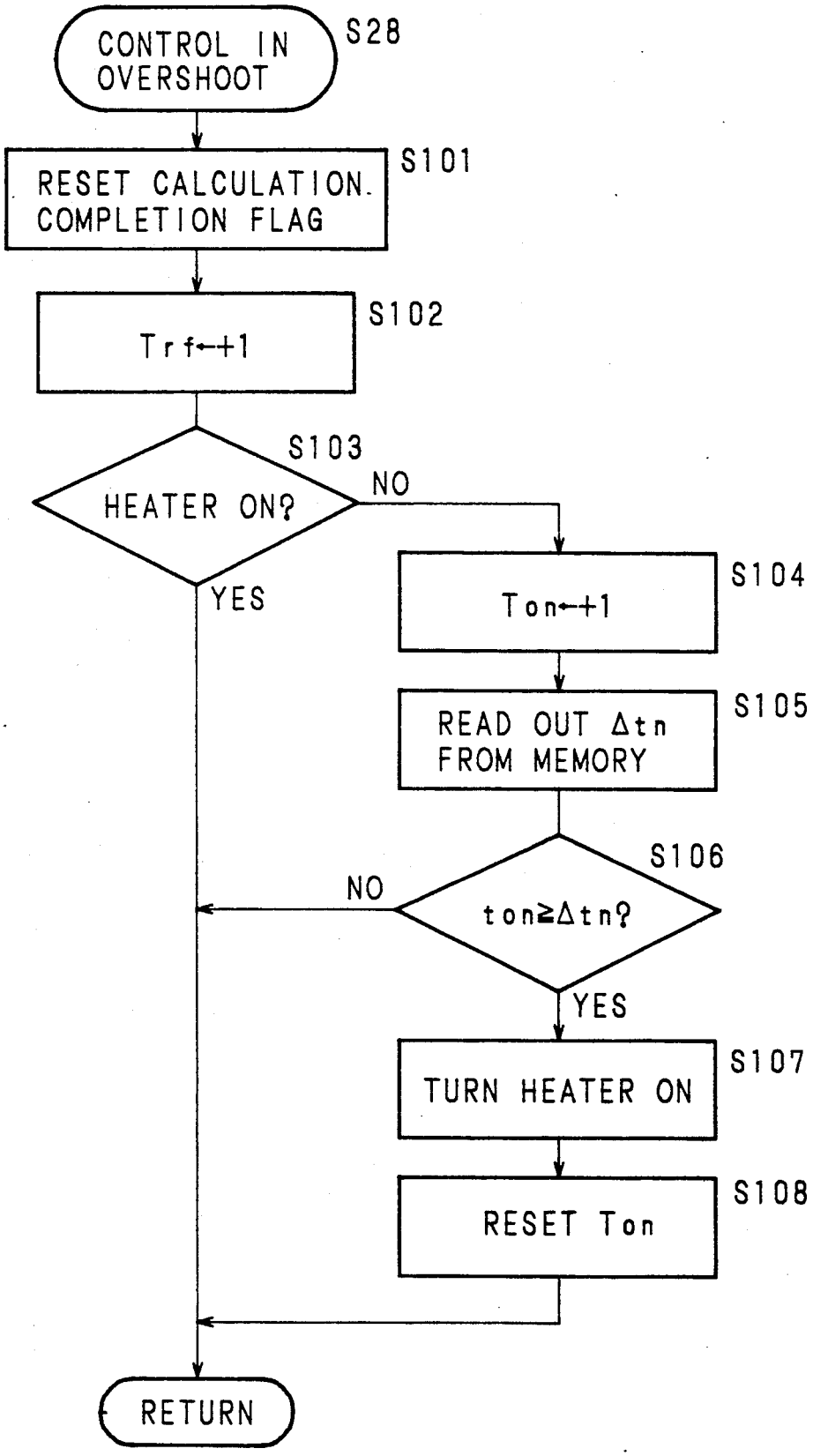
FIG. 32 is a flow chart showing a subroutine for a control at the time of overshoot.
Figure 33:
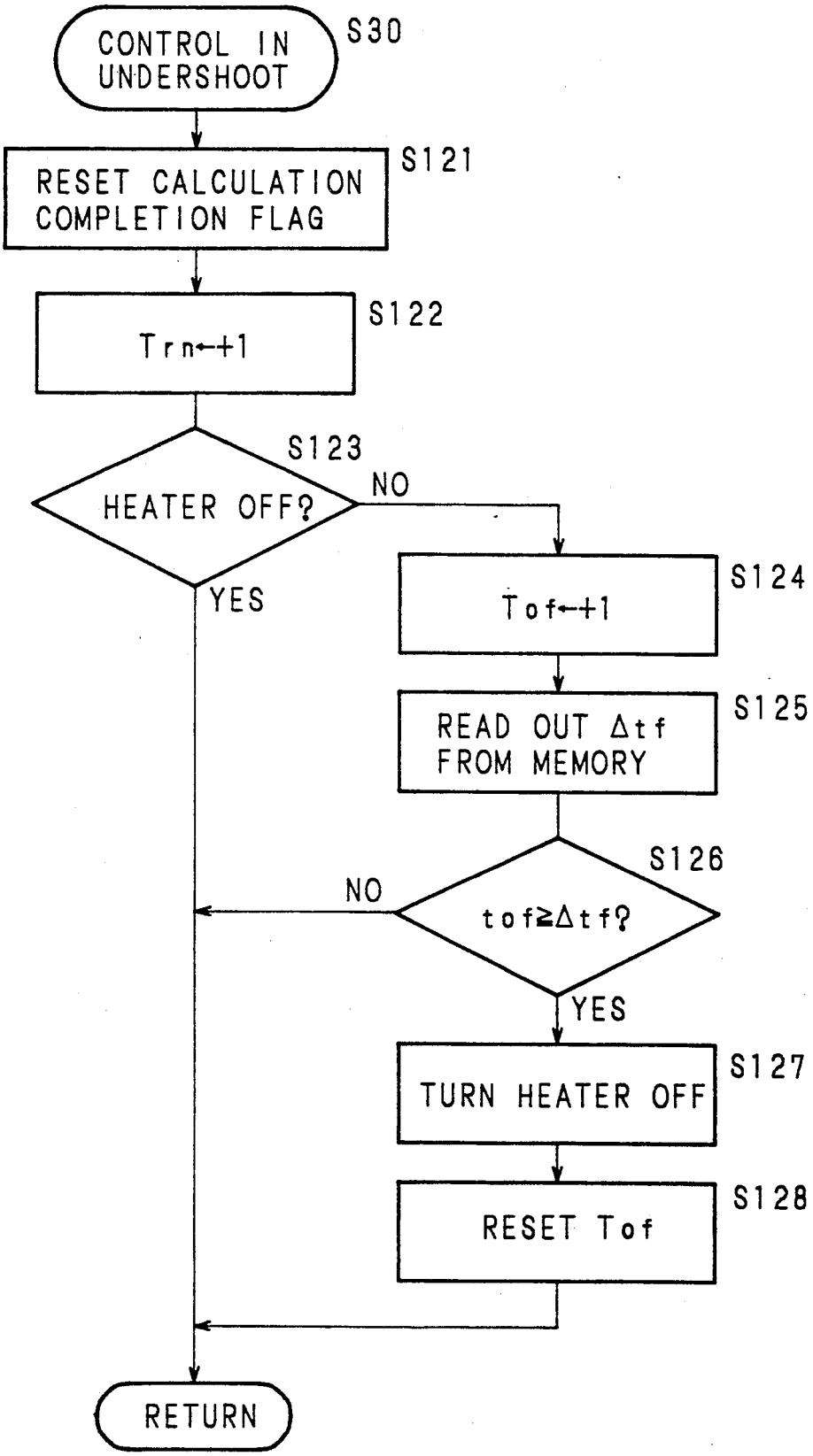
FIG. 33 is a flow chart showing a subroutine for a control at the time of undershoot.

In the control at the time of overshoot and undershoot, the subroutine shown in FIG. 32 is executed instead of the one shown in FIGS. 24, 25, and the subroutine shown in FIG. 33 is executed instead of the one shown in FIGS. 26, 27. In the control at the time of overshoot, each time the subroutine shown in FIG. 32 is called, a response counter Trf is caused to start counting in Step S102. In the control at the time of undershoot, each time the subroutine shown in FIG. 33 is called, a response counter Trn is caused to start counting in Step S122. The processing executed in other Steps S103 to S108, S123 to S128 in the second embodiment is similar to the one executed in the same Steps in the first embodiment.

Figure 34:
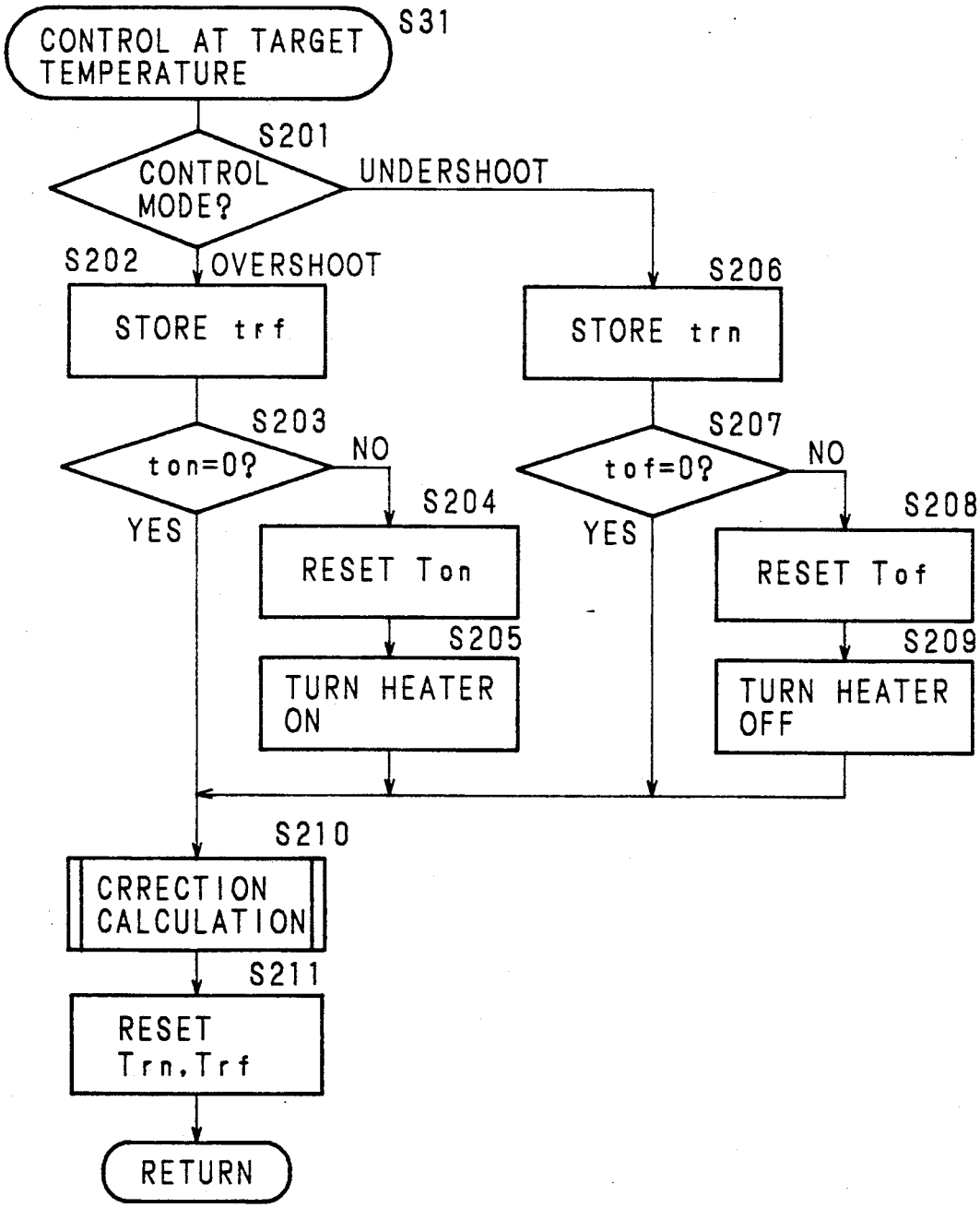
FIG. 34 is a flow chart showing a subroutine for a control at the target temperature.

Further, in the control at the target temperature, the subroutine shown in FIG. 34 is executed instead of the one shown in FIG. 28.

In this embodiment, upon the fixing temperature reaching the target temperature, the temperature control is changed to the undershoot control if the overshoot control has been executed. On the other hand, the temperature control is changed to the overshoot control if the undershoot control has been executed.

Firstly, in Step S201, it is discriminated whether the temperature control has been the overshoot control or undershoot control. If the temperature control has been the overshoot control, a count value trf of the response counter Trf is stored in Step S202. In Step S203, it is discriminated whether the count value ton of the timer Ton is 0. If the count value ton is 0 (YES in Step S203), this subroutine proceeds to Step S210. If the count value ton is not 0 (NO in Step S203), the timer Ton is reset in Step S204 and the heater 12 is turned on in Step S205 because the fixing temperature is decreasing below the target temperature, then proceeding to Step S210.

On the contrary, if the temperature control has been the undershoot control, the count value trn of the response counter Trn is stored in Step S206. It is discriminated whether the count value tof of the timer Tof is 0 in Step S207. If the count value tof is 0 (YES in Step S207), the subroutine proceeds to Step S210. If the count value tof is not 0 (NO in Step S207), the timer Tof is reset in Step S208 and the heater 12 is turned off in Step S209 because the fixing temperature is increasing above the target temperature, then proceeding to Step S210.

In Step S210, the correction calculation is executed. Subsequently, the response counters Trn, Trf are reset in Step S211, whereby completing this subroutine.

Figure 35:
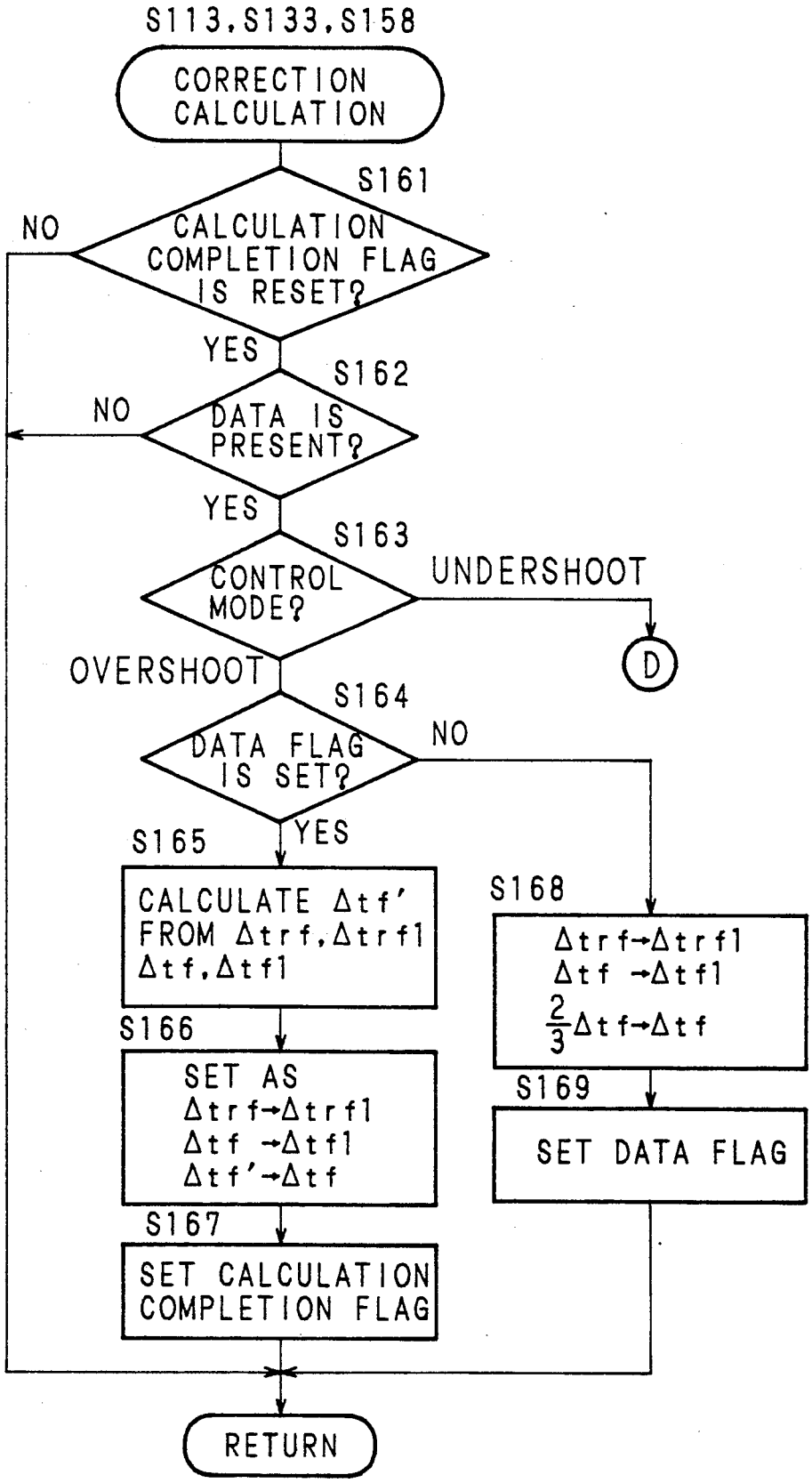
FIGS. 35, 36 are flow charts showing a subroutine for executing a correction calculation.
Figure 36:
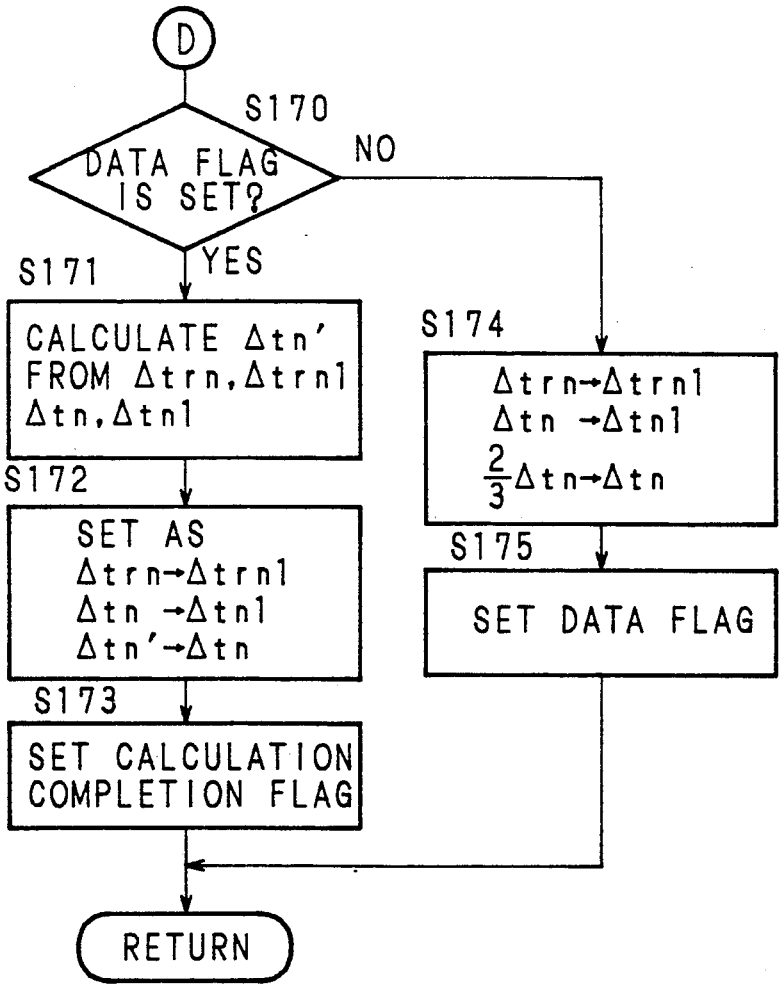

FIGS. 35, 36 shows a subroutine of a correction calculation control executed in Step S210.

This subroutine is basically similar to the one shown in FIGS. 29, 30. The data to be calculated are ($\Delta$tf, $\Delta$trf), ($\Delta$tf1, $\Delta$trf1) at the time of overshoot, and ($\Delta$tr, $\Delta$trn), ($\Delta$tn1, $\Delta$trn1) at the time of undershoot. The next off-time $\Delta$tf' and the next on-time $\Delta$tn' are calculated in the respective cases. Step numbers used in FIGS. 35, 36 are same as those used in FIGS. 29, 30.

It will be understood that a fixing unit in accordance with the present invention is not limited to the foregoing two embodiments, and can be modified in various manners within the scope of the invention.

For example, the invention may be applied to an electrophotographic copying machine of the analog type which uses visible light besides a laser beam printer.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. An image forming apparatus including a fixing unit having a heating roller provided internally with a heater, the apparatus comprising:

detecting means for detecting the surface temperature of the heating roller;

storing means for storing an on-time which starts after it is detected that the surface temperature has reached a predetermined value and ends when the heater is switched on, and an off-time which starts after it is detected that the surface temperature has reached the predetermined value and ends when the heater is switched off;

control means for controlling the on/off timing of the heater on the basis of the on-time and off-time stored in said storing means; and changing means for changing the on-time and off-time based on an actual change in the surface temperature of the heating roller caused by the control of said control means.

2. An image forming apparatus as defined in claim 1 further comprising rewriting means for rewriting the on-time and off-time stored in said storing means into the on-time and off-time changed by said changing means.

3. An image forming apparatus including a fixing unit for fixing a toner image onto a paper with the use of a heating roller provided internally with a heater, the apparatus comprising:

detecting means for detecting the surface temperature of the heating roller;

discriminating means for discriminating the type of the paper to be used;

setting means for setting, on the basis of the discrimination result of said discriminating means, an on-time which starts after it is detected that the surface temperature has reached a predetermined value and ends when the heater is switched on, and an off-time which starts after it is detected that the surface temperature has reached the predetermined value and ends when the heater is switched off; and control means for controlling the on/off timing of the heater on the basis of the on-time and off-time set by said setting means.

4. An image forming apparatus as defined in claim 3 wherein said setting means includes a memory for storing a plurality of on-times and off-times whose durations differ from one another so as to correspond to the types of paper to be used, and sets one on-time and one off-time out of the plurality of on-times and off-times stored in said memory on the basis of the discrimination result of said discriminating means.

5. An image forming apparatus including a fixing unit having a heating roller provided internally with a heater, the apparatus comprising:

detecting means for detecting the surface temperature of the heating roller;

estimating means for estimating ambient temperature of the fixing unit;

setting means for setting, on the basis of the estimation result of said estimating means, an on-time which starts after it is detected that the surface temperature has risen over a predetermined value and ends when the heater is switched on, and an off-time which starts after it is detected that the surface temperature has fallen below the predetermined value and ends when the heater is switched off; and control means for controlling the on/off timing of the heater on the basis of the on-time and off-time set by said setting means.

6. An image forming apparatus as defined in claim 5 further comprising:

means for supplying power to the heater; and time measuring means for measuring a time which starts upon start of the power supply to the heater and ends when it is detected that the surface temperature has reached the predetermined value;

wherein the estimating means estimates the ambient temperature on the basis of the measurement result of said time measuring means.

7. An image forming apparatus as defined in claim 5 further comprising:

time measuring means for measuring a time during which the surface temperature of the heating roller is below the predetermined value;

wherein the estimating means estimates the ambient temperature on the basis of the measurement result of said time measuring means.

8. An image forming apparatus as defined in claim 5 wherein said setting means includes a memory for storing a plurality of on-times and off-times whose durations differ from one another so as to correspond to the ambient temperature, and sets one on-time and one off-time out of the plurality of on-times and off-times stored in said memory on the basis of the estimation result of said estimating means.

9. An image forming apparatus including a fixing unit for fixing a toner image onto a paper with the use of a heating roller provided internally with a heater, the apparatus comprising:

detecting means for detecting the surface temperature of the heating roller;

discriminating means for discriminating the type of the paper to be used;

estimating means for estimating ambient temperature of the fixing unit;

setting means for setting, on the basis of the discrimination result of said discriminating means and the estimation result of said estimating means, an on-time which starts after it is detected that the surface temperature has reached a predetermined value and ends when the heater is switched on, and an off-time which starts after it is detected that the surface temperature has reached the predetermined value and ends when the heater is switched off; and control means for controlling the on/off timing of the heater on the basis of the on-time and off-time set by said setting means.

10. An image forming apparatus as defined in claim 9 wherein the setting means includes a memory for storing a table in which the type of paper to be used, the ambient temperature of the fixing unit, and on-time and off-time are corresponded with one another, and sets one on-time and one off-time according to the table stored in said memory on the basis of the discrimination result of said discriminating means and the estimation result of said estimating means.

11. An image forming apparatus including a fixing unit having a heating roller provided internally with a heater, the apparatus comprising:

detecting means for detecting the surface temperature of the heating roller;

storing means for storing an on-time which starts after it is detected that the surface temperature has reached a predetermined value and ends when the heater is switched on, and an off-time which starts after it is detected that the surface temperature has reached the predetermined value and ends when the heater is switched off;

measuring means for measuring data corresponding to a change in the surface temperature detected by said detecting means;

calculating means for calculating a new on-time and off-time based on the measured data; and changing means for changing the content of said storing means into the new calculated on-time and off-time.

12. An image forming apparatus as defined in claim 11 wherein said measuring means measures a time during which the surface temperature is above the predetermined value, and said calculating means calculates a new on-time based on the time measured by said measuring means.

13. An image forming apparatus as defined in claim 12 wherein said calculating means calculates a new on-time so as to reduce the time during which the surface temperature is above the predetermined value to zero.

14. An image forming apparatus as defined in claim 11 wherein said measuring means measures a time during which the surface temperature is below the predetermined value, and said calculating means calculates a new off-time based on the time measured by said measuring means.

15. An image forming apparatus as defined in claim 14 wherein said calculating means calculates a new off-time so as to reduce the time during which the surface temperature is below the predetermined value to zero.

16. An image forming apparatus as defined in claim 11 wherein said measuring means measures a difference between a maximum value of the surface temperature and the predetermined value, and the calculating means calculates a new on-time based on the measured difference.

17. An image forming apparatus as defined in claim 16 wherein the calculating means calculates a new on-time so as to reduce the difference between the maximum value of the surface temperature and the predetermined value to zero.

18. An image forming apparatus as defined in claim 11 wherein said measuring means measures a difference between a minimum value of the surface temperature and the predetermined value, and the calculating means calculates a new off-time based on the measured difference.

19. An image forming apparatus as defined in claim 18 wherein said calculating means calculates a new off-time so as to reduce the difference between the minimum value of the surface temperature and the predetermined value to zero.

20. An image forming apparatus including a fixing unit having a heating roller provided internally with a heater, the apparatus comprising:

detecting means for detecting the surface temperature of the heating roller;

discriminating means for discriminating a use condition of the apparatus;

storing means for storing a plurality of temperature control patterns which differ from one another so as to correspond to the use condition of the apparatus;

selecting means for selecting one out of the plurality of temperature control patterns according to the discriminated use condition;

control means for controlling the temperature of the heater on the basis of the selected temperature control pattern;

calculating means for calculating a new temperature control pattern based on the detected surface temperature of the heating roller caused by the control of said control means; and changing means for changing the content of said storing means into a new calculated temperature control pattern.

21. An image forming apparatus as defined in claim 20 wherein the fixing unit fixes a toner image onto a paper with the use of the heating roller, and said discriminating means discriminates the type of the paper to be used.

22. An image forming apparatus as defined in claim 20 wherein said discriminating means discriminates ambient temperature of the fixing unit.

* * * * *